US009943134B2

(12) United States Patent
Holmes et al.

(10) Patent No.: US 9,943,134 B2
(45) Date of Patent: Apr. 17, 2018

(54) ARTICLE OF FOOTWEAR

(71) Applicant: NIKE, Inc., Beaverton, OR (US)

(72) Inventors: Matt Holmes, Beaverton, OR (US); Eric P. Avar, Beaverton, OR (US); Jeongwoo Lee, Beaverton, OR (US); Fanny Ho, Portland, OR (US); Bryant Klug, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 695 days.

(21) Appl. No.: 13/693,596

(22) Filed: Dec. 4, 2012

(65) Prior Publication Data

US 2014/0150297 A1 Jun. 5, 2014

(51) Int. Cl.

| | |
|---|---|
| ***A43B 13/12*** | (2006.01) |
| ***A43B 13/14*** | (2006.01) |
| ***A43B 13/22*** | (2006.01) |
| ***A43B 13/36*** | (2006.01) |
| ***A43B 17/02*** | (2006.01) |
| ***A43B 5/06*** | (2006.01) |

(52) U.S. Cl.

CPC ..... *A43B 13/125* (2013.01); *A43B 5/06* (2013.01); *A43B 13/141* (2013.01); *A43B 13/226* (2013.01); *A43B 13/36* (2013.01); *A43B 17/02* (2013.01)

(58) Field of Classification Search

CPC .. A43B 3/24; A43B 3/246; A43B 5/06; A43B 7/146; A43B 13/12; A43B 13/122; A43B 13/135; A43B 13/141; A43B 13/36; A43B 17/02

USPC ..... 36/100, 103, 25 R, 28, 30 R, 141

See application file for complete search history.

(56) References Cited

U.S. PATENT DOCUMENTS

| | | | | |
|---|---|---|---|---|
| 4,638,576 | A * | 1/1987 | Parracho | A43B 5/00 36/30 R |
| 6,023,857 | A | 2/2000 | Vizy et al. | |
| 6,092,305 | A * | 7/2000 | Troy | A43B 1/0081 36/103 |
| 6,519,876 | B1 * | 2/2003 | Geer | A43B 1/0081 36/102 |
| 6,857,202 | B2 * | 2/2005 | Pfander | A43B 1/0009 36/28 |
| 6,990,755 | B2 | 1/2006 | Hatfield et al. | |
| 7,013,583 | B2 * | 3/2006 | Greene | A43B 7/141 36/144 |

(Continued)

FOREIGN PATENT DOCUMENTS

| | | | |
|---|---|---|---|
| CN | 1882260 | A | 12/2006 |
| JP | 2003-024104 | A | 1/2003 |
| WO | 2010042924 | A1 | 4/2010 |

OTHER PUBLICATIONS

U.S. Appl. No. 13/681,842, titled "Footwear Upper Incorporating a Knitted Component with Collar and Throat Portions", filed Nov. 20, 2012.

International Search Report and Written Opinion for PCT/US2013/072637 dated Mar. 11, 2014.

Patent Examination Report No. 2 in AU2013356324 dated Sep. 16, 2016.

(Continued)

*Primary Examiner* — Sharon M Prange

(74) *Attorney, Agent, or Firm* — Banner & Witcoff, Ltd.

(57) ABSTRACT

An article of footwear may include an upper and an outsole bonded to the upper. The outsole may include multiple discrete lugs distributed across a bottom exterior surface of the outsole. The article may further include a compressible foam midsole contained within the upper. The midsole may be non-destructively removable from the upper.

14 Claims, 20 Drawing Sheets

(56) References Cited

U.S. PATENT DOCUMENTS

| | | | | |
|---|---|---|---|---|
| 7,140,129 | B2 * | 11/2006 | Newson | A43B 5/18 36/100 |
| 7,513,064 | B2 * | 4/2009 | Fuerst | A43B 1/14 36/102 |
| 7,946,058 | B2 * | 5/2011 | Johnson | A43B 3/0057 36/102 |
| 8,186,078 | B2 | 5/2012 | Avar et al. | |
| 8,205,357 | B2 * | 6/2012 | Keating | A43B 5/10 36/141 |
| 2003/0079373 | A1 | 5/2003 | Geer et al. | |
| 2004/0221485 | A1 | 11/2004 | Pfander | |
| 2005/0016023 | A1 | 1/2005 | Burris et al. | |
| 2005/0268487 | A1 | 12/2005 | Ellis | |
| 2006/0130364 | A1 | 6/2006 | Greene et al. | |
| 2010/0212185 | A1 | 8/2010 | Cooper et al. | |
| 2012/0180335 | A1 * | 7/2012 | Mahoney | A43B 7/144 36/28 |

OTHER PUBLICATIONS

Office Action in KR10-2015-7016848 dated Nov. 21, 2016.
Notification of First Office Action in CN2013800631074 dated May 5, 2016.
Office Action in CA 2,892,077 dated Apr. 19, 2016.
Notice of Reasons for Rejection in JP 2015-546537 dated May 11, 2016.
Notification of Second Office Action in CN201380063107.4 dated Jan. 22, 2017, with Summary of Second Office Action in English.

* cited by examiner

ARTICLE OF FOOTWEAR

BACKGROUND

Conventional articles of footwear generally include two primary components: an upper and a sole structure. The upper provides a covering for the foot and securely positions the foot relative to the sole structure. The sole structure is secured to a lower surface of the upper and configured so as to be positioned between the foot and the ground when a wearer is standing, walking or running. Sole structures are often designed so as to cushion, protect and support the foot. Sole structures may also be designed so as to increase traction and to help control potentially harmful foot motion such as overpronation.

Many types of athletic footwear have a sole structure that includes a deformable midsole. A primary element of many conventional midsoles is a resilient polymer foam material that extends throughout the length of the footwear. The physical characteristics of a midsole often depend on the density and other properties of the polymer foam material and on the dimensional configuration of the midsole. By varying these factors throughout the midsole, the relative stiffness, degree of ground reaction force attenuation, and energy absorption properties may be altered to meet the specific demands of the activity for which the footwear is intended to be used.

Cushioning and impact attenuation are valuable attributes of a sole structure. However, components that provide these attributes also tend to reduce the degree to which a shoe wearer can sense ground contours and other features. This loss of sensation regarding ground features can be disadvantageous. The feel of a ground surface sensed by the underside of a person's foot can provide useful cues regarding conditions of the ground over which that person may be moving. When sensing rough, uneven and/or loose terrain, for example, a runner may adjust his or her motions.

Commonly-owned U.S. Pat. No. 6,990,755 describes an article of footwear having an articulated sole structure in which multiple sipes separate discrete sole elements of the midsole. The resulting sole structure helps to simulate a sensation of barefoot running while at the same time providing a degree of cushioning and protection to the wearer foot. However, there remains an ongoing need for improved footwear that protects the wearer foot but that also provides a natural motion feel and tactile feedback regarding ground conditions.

SUMMARY

This Summary is provided to introduce a selection of concepts in a simplified form that are further described below in the Detailed Description. This Summary is not intended to identify key features or essential features of the invention.

In some embodiments, an article of footwear may include an upper, an outsole and a compressible foam midsole. The outsole may be bonded directly to an exterior face of a lasting element of the upper. The midsole may be contained within, and be non-destructively removable from, the upper.

In some embodiments, an article of footwear may include an upper and an outsole. The outsole may include multiple discrete lugs distributed across a bottom exterior surface of the outsole. A compressible foam midsole may be contained within the upper. That midsole may be non-destructively removable from the upper and may include a plurality of raised regions on a top surface configured to receive a plantar face of a foot of a wearer.

In some embodiments, an article of footwear may include an upper and an outsole bonded to the upper. The outsole may include multiple discrete lugs distributed across a bottom exterior surface of the outsole. Each of the lugs may be separated from adjacent lugs by a gap region. The outsole may have a thickness of between about 0.5 millimeters and about 0.8 millimeters in the gap regions. The article may further include a compressible foam midsole contained within the upper.

Additional embodiments are described herein.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1A:
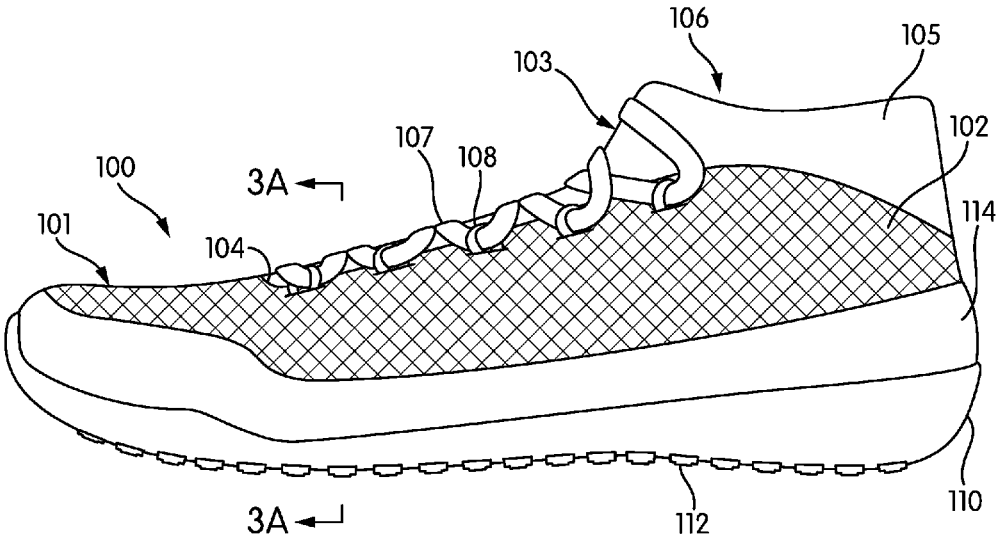
FIGS. 1A and 1B are respective lateral and medial side views of an article of footwear according to some embodiments.

In at least some embodiments, an article of footwear comprises a thin and highly flexible outsole. The outsole may be directly bonded to an upper of the article. In certain embodiments, the outsole may be directly bonded to the underside of a lasting element of that upper. The outsole may further comprise multiple discrete lugs. The article may further include an internal foam midsole resting directly over the lasting element. In response to ground forces imposed by walking, running or other actions by the article wearer, individual lugs may displace vertically to provide localized pressure on the midsole. The midsole may then transfer a portion of that localized pressure to a localized region of the wearer's foot. As a result, the wearer may receive tactile feedback that provides information about the condition of the ground surface over which the wearer may be moving. An article of footwear according to at least some embodiments may provide a wearer with a highly defined feel for ground surface features, while still affording impact force attenuation and other protection. As further described herein, additional features of one or more embodiments may further enhance the degree to which a wearer is able to sense physical details of a ground surface.

The following discussion and accompanying figures describe articles of footwear in accordance with several embodiments. Shoes according to various embodiments have configurations that are suitable for athletic activities such as running and cross-training. Other embodiments include footwear adapted for basketball, golf, walking, hiking and other athletic and nonathletic activities. Persons skilled in the relevant art will thus recognize that concepts disclosed herein may be applied to a wide range of footwear styles and are not limited to the specific embodiments discussed below and depicted in the figures.

To assist and clarify subsequent description of various embodiments, various terms are defined herein. Unless context indicates otherwise, the following definitions apply throughout this specification (including the claims). "Shoe" and "article of footwear" are used interchangeably to refer to articles intended for wear on a human foot. A shoe may or may not enclose the entire foot of a wearer. For example, a shoe could include a sandal or other article that exposes large portions of a wearing foot. The "interior" of a shoe refers to space that is occupied by a wearer's foot when the shoe is worn. An interior side, surface, face or other aspect of a shoe component refers to a side, surface, face or other aspect of that component that is (or will be) oriented toward the shoe interior in a completed shoe. An exterior side, surface, face or other aspect of a component refers to a side, surface, face or other aspect of that component that is (or will be) oriented away from the shoe interior in the completed shoe. In some cases, the interior side, surface, face or other aspect of a component may have other elements between that interior side, surface, face or other aspect and the interior in the completed shoe. Similarly, an exterior side, surface, face or other aspect of a component may have other elements between that exterior side, surface, face or other aspect and the space external to the completed shoe.

Unless the context indicates otherwise, "top," "bottom," "over," "under," "above," "below," and similar locational terms assume that a shoe or shoe structure of interest is in the orientation that would result if the shoe (or shoe incorporating the shoe structure of interest) is in an undeformed condition with its outsole (and/or other ground-contacting sole structure element(s)) resting on a flat horizontal surface. Notably, however, the term "upper" is reserved for use in describing the component of a shoe that at least partially covers a wearer foot and helps to secure the wearer foot to a shoe sole structure.

Elements of a shoe can be described based on regions and/or anatomical structures of a human foot wearing that shoe, and by assuming that shoe is properly sized for the wearing foot. As an example, a forefoot region of a foot includes the metatarsal and phalangeal bones. A forefoot element of a shoe is an element having one or more portions located over, under, to the lateral and/or medial sides of, and/or in front of a wearer's forefoot (or portion thereof) when the shoe is worn. As another example, a midfoot region of a foot includes the cuboid, navicular, medial cuneiform, intermediate cuneiform and lateral cuneiform bones and the heads of the metatarsal bones. A midfoot element of a shoe is an element having one or more portions located over, under and/or to the lateral and/or medial sides of a wearer's midfoot (or portion thereof) when the shoe is worn. As a further example, a heel region of a foot includes the talus and calcaneus bones. A heel element of a shoe is an element having one or more portions located over, under, to the lateral and/or medial sides of, and/or behind a wearer's heel (or portion thereof) when the shoe is worn. The forefoot region may overlap with the midfoot region, as may the midfoot and heel regions.

Unless indicated otherwise, a longitudinal axis refers to a horizontal heel-toe axis along the center of a shoe and that is roughly parallel to a line that would follow along the second metatarsal and second phalanges of a wearer foot. A transverse axis refers to a horizontal axis across a shoe that is generally perpendicular to a longitudinal axis. A longitudinal direction is parallel (or roughly parallel) to a longitudinal axis. A transverse direction is parallel (or roughly parallel) to a transverse axis.

Figure 1B:
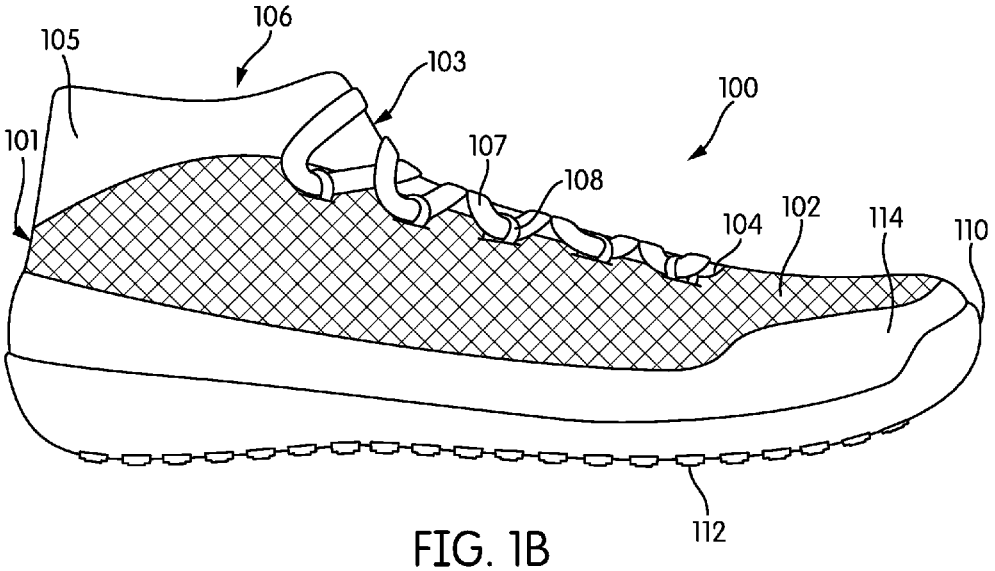

FIGS. 1A and 1B are lateral side and medial side views, respectively, of a shoe 100 according to some embodiments. Shoe 100 is a left foot shoe and is part of a pair that includes a right foot shoe (not shown) that is a mirror image of shoe 100. Shoe 100 includes an upper 101 configured to surround and retain the foot of a shoe 100 wearer. Upper 101 and uppers shown in other drawings are merely exemplary. There are innumerable additional embodiments in which an upper may be functionally similar to upper 101 and/or to an upper shown in other drawing figures, but which may have a different visual appearance.

In the embodiment of shoe 100, upper 101 may comprise a lightweight mesh panel 102 and a partial sock 103. Partial sock 103 may be formed from a knit textile material that includes elastic fibers. Partial sock 103 includes an ankle collar 105 that completely surrounds a wearer foot at or above ankle level. An opening 106 in ankle collar 105 allows a wearer to insert a foot into the interior of shoe 100. The ankle collar 105 and/or partial sock 103 may provide a tight fit to the wearer foot. In some embodiments, the ankle collar 105 and/or partial sock 103 may include features (e.g., raised ribs, nubs, etc.) that apply localized pressure to the wearer foot, e.g., to enhance proprioception.

Mesh panel 102 covers the sides of the wearer foot and the top of the wearer foot in a forefoot region forward of a lacing gap 104. Lacing gap 104 is analogous to a tongue opening in certain conventional footwear designs. In the embodiment of shoe 100, however, a conventional tongue is not included. Instead, edges of partial sock 103 are joined to mesh panel 102 at or near edges of lacing gap 104. Other edges of partial sock 103 around a lower portion of ankle collar 105 are joined to top edges of mesh panel 102 in a heel region of upper 101. A lace 107 passes through multiple loops 108 and can be used to cinch upper 101 onto a wearer foot.

Although not visible in FIGS. 1A and 1B, upper 101 includes a lasting element (e.g., a Strobel) that is stitched, bonded or otherwise attached to the lower edge of mesh panel 102 and that generally extends the entire length and width of upper 101. That lasting element forms the bottom portion of upper 101. The exterior face of that lasting element is bonded directly to outsole 110. As explained in more detail below, outsole 110 is highly flexible and includes multiple lugs 112 distributed across a bottom outer surface. As also explained below, shoe 100 further includes a compressible foam midsole located within the interior of upper 101. That midsole rests directly on the interior face of the upper 101 lasting element, with a top surface of that midsole forming a footbed for the shoe 100 wearer. Outsole 110 and the midsole form portions of the shoe 100 sole structure. When a wearer tightens lace 107, that sole structure is secured to the underside (plantar surface) of the wearer's foot. Lower ends of lacing loops 108 may be attached to edges of the lasting element (and thereby extend around at least somewhat beneath the plantar face of the wearer foot) so that the lacing loops extend and wrap around the sides and a portion of the bottom of the wearer foot.

Mesh panel 102 of upper 101 further includes a skin portion 114 bonded to the exterior face of the mesh. Skin portion 114 may be formed from thermoplastic polyurethane (TPU), from TPU having a polyurethane (PU) exterior face, or from other polymer materials. In some embodiments, mesh panel 102 may be formed using materials and techniques as described in commonly owned U.S. patent application Ser. No. 12/603,498, filed Oct. 21, 2009, and titled "Composite Shoe Upper and Method of Making Same," which application is incorporated by reference herein in its entirety.

Figure 1C:
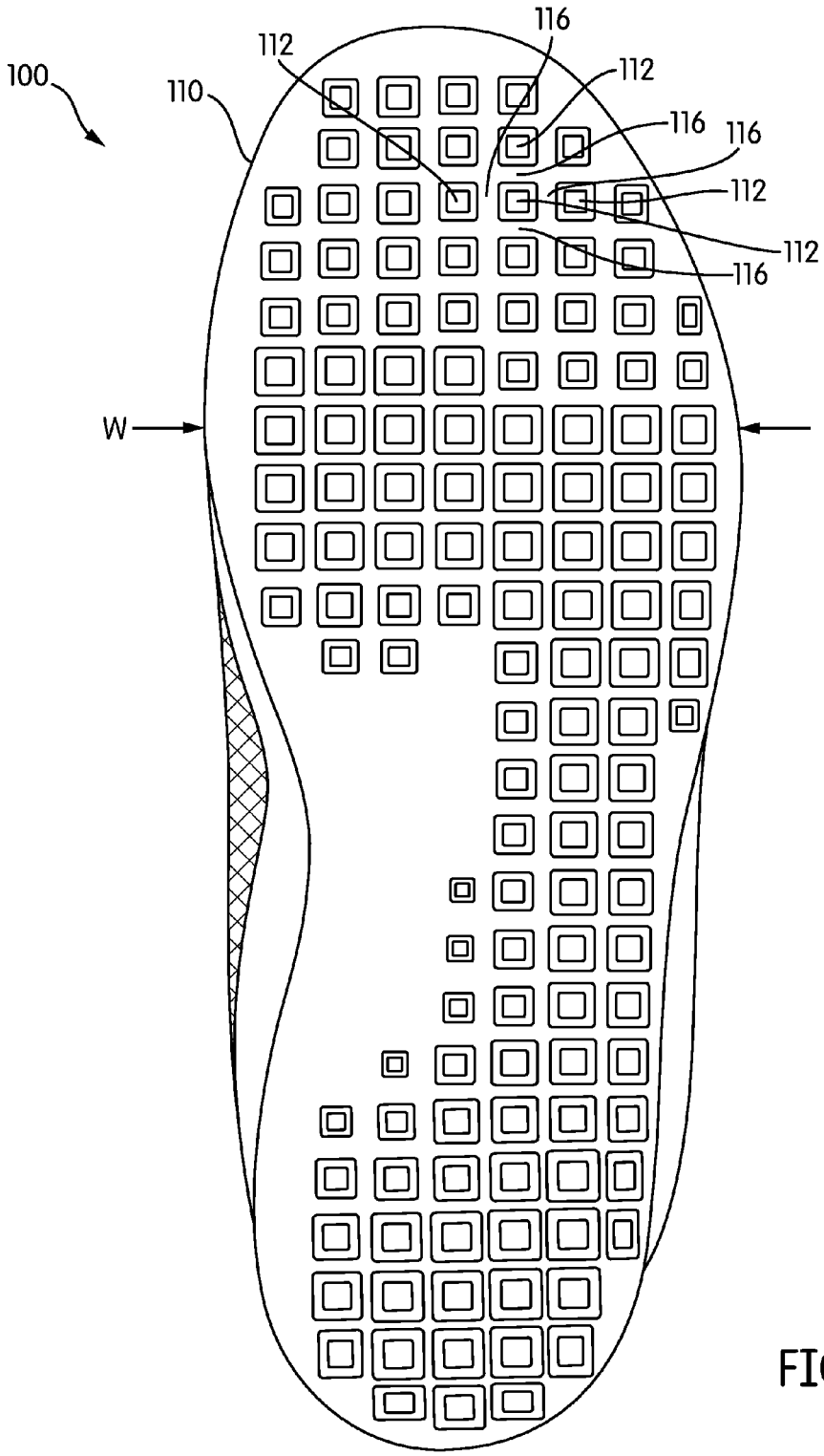
FIG. 1C is a bottom view of the article of footwear of FIGS. 1A and 1B.

FIG. 1C is a bottom view of shoe 100 and shows additional details of the bottom exterior surface of outsole 110. Outsole 110 and outsoles shown in other drawings are merely exemplary. There are innumerable additional embodiments in which an outsole may be functionally similar to outsole 110 and/or to an outsole shown in other drawing figures, but which may have a different visual appearance.

As previously indicated, and as further shown in FIG. 1C, outsole 110 includes multiple lugs 112 distributed over the exterior ground contacting region of outsole 110. In some embodiments, lugs are distributed over at least the forefoot region. In some embodiments, and as seen in FIG. 1C, lugs may be distributed over the forefoot region and much of the midfoot and heel regions. Lugs 112 are discrete. In particular, each lug 112 is separated from adjacent lugs by a gap 116. To avoid obscuring FIG. 1C with text, only some of lugs 112 and gaps 116 are labeled in FIG. 1C to indicate the relative arrangement of lugs and gaps.

The sizes of lugs 112 may vary based on location. Moreover, the heights of lugs 112 may also vary based on location. As used herein, the "height" of a lug refers to the amount by which the lug extends beyond the exterior surface of outsole 110 that forms gaps 116 surrounding that lug. In some embodiments, lugs located in regions that are expected to experience greater foot pressure may have heights that are greater than the heights of lugs in other regions. The regions that are expected to experience greater pressure may vary based on the activity for which a particular shoe is intended. In at least some embodiments, such regions may include the heel region, the region of the metatarsal-phalangeal joints, and the big toe (i.e., the hallux).

In at least some embodiments, lugs 112 have a cross-sectional area size that is small relative to the area of the outsole 110 ground contact surface. For example, and as seen in FIG. 1C, the widest portion of outsole 110 is labeled "W." Approximately eight lugs 112 fit within that widest portion 112. In some embodiments, and for some or all lugs 112, the largest width of an individual lug is approximately 0.4 inches (10.2 mm) or less. In the embodiment of shoe 100, for example, lugs 112 have square cross sections. The largest width of such a square lug is thus the diagonal dimension from one corner to another corner. In some embodiments, the largest width of some or all lugs may be smaller (e.g., approximately 0.3 inches (7.6 mm) or less, approximately 0.25 inches (6.4 mm) or less, approximately 0.15 inches (3.8 mm) or less). In other embodiments, lugs may also have other shapes. Some embodiments may also include an outsole that comprises lugs of different cross sectional shapes.

In some embodiments, and as can also been seen in FIG. 1C, the spacing between lugs 112 may vary based on location. For example, gaps 116 between heel region lugs are relatively narrow. An example of such a heel region gap width in some embodiments is between approximately 0.015 inches and approximately 0.025 inches (e.g., approximately 0.02 inches). Conversely, gaps 116 between lugs in various forefoot regions are relatively wide. An example of such a forefoot region gap width in some embodiments is between approximately 0.1 inches and approximately 0.16 inches (e.g., approximately 0.13 inches). These gap widths are only examples, however, and gaps in these and/or other regions may have widths outside of these ranges in some embodiments.

Outsole 110 may be formed from synthetic rubber having a hardness and other properties similar to those of synthetic rubber compounds conventionally used for footwear outsoles. As previously indicated, however, outsole 110 is highly flexible. Accordingly, outsole 110 in at least some embodiments has a thickness of between approximately 0.5 millimeters to approximately 0.8 millimeters in regions of gaps 116. This permits outsole 110 to flex significantly between adjacent lugs 112. In turn, this allows individual lugs 112 to transfer ground pressure to a wearer foot with a higher definition (e.g., by displacing with respect to adjacent lugs in the vertical direction). This permits a wearer of shoe 100 to better feel individual features of the ground or other surface on which the wearer is standing, walking, running, etc. In some embodiments, portions of outsole 110 may be formed from a rubber compound that is harder and more durable than other portions of the outsole. The higher durability rubber could be used, e.g., in a crash pad located within the heel region and/or on the bottoms of lugs located in certain other high pressure regions that typically wear more quickly.

Figure 2A:
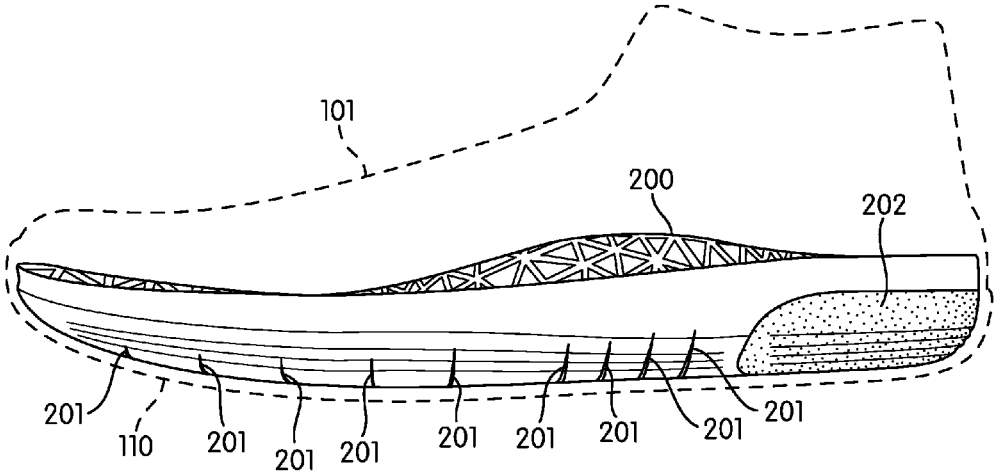
FIGS. 2A through 2D are lateral side, medial side, front and rear views, respectively, of a midsole from the article of footwear of FIGS. 1A and 1B.
Figure 2B:
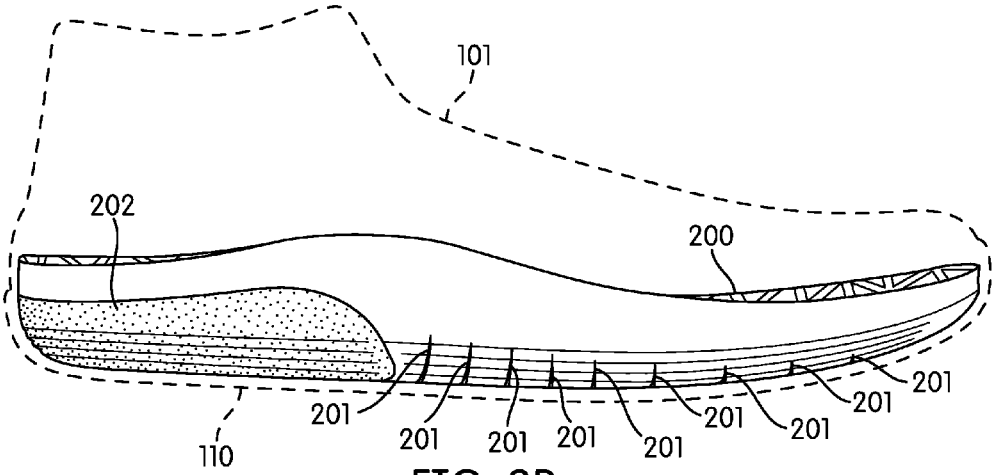
Figure 2C:
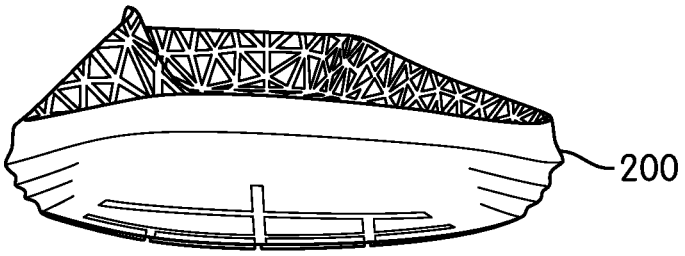
Figure 2D:
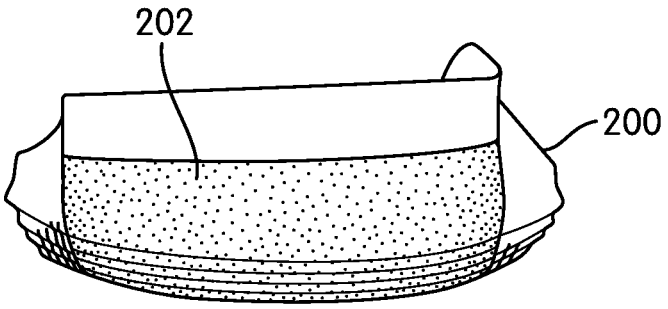

FIGS. 2A and 2B are respective lateral and medial side views of a midsole 200 of shoe 100. FIGS. 2C and 2D are respective front and rear views of midsole 200. Midsole 200 and midsoles shown in other drawings are merely exemplary. There are innumerable additional embodiments in which a midsole may be functionally similar to midsole 200 and/or to a midsole shown in other drawing figures, but which may have a different visual appearance.

So as to generally show the position of midsole 200 within shoe 100, upper 101 and outsole 110 are approximately indicated with broken lines in FIGS. 2A and 2B. Midsole 200 attenuates ground reaction forces and absorbs energy when a wearer of shoe 100 walks, runs, jumps, etc. Midsole 200 is not permanently attached to upper 101 or to outsole 110. Instead, midsole 200 simply rests within shoe 100. Midsole 200 can be nondestructively removed from shoe 100 through opening 106 of ankle collar 105 (see FIGS. 1A and 1B) and then replaced through opening 106.

Midsole 200 may also include a heel reinforcement 202. Heel reinforcement 202 may be formed from a foam that is denser and less compressible than other portions of midsole 200, and it may be formed as a separate component engaged with the foam material of the midsole 200. Heel reinforcement 202 helps provide stability to a wearer foot by centering the wearer heel. In some embodiments, the shape and/or location of a heel reinforcement may vary. A heel reinforcement configuration may vary based on an intended use of a shoe and/or based on gait characteristics of a wearer. For example, a midsole of a shoe intended for wear while playing basketball may have a heel reinforcement that is larger and/or more dense than a heel reinforcement of a midsole of a shoe intended for linear running. As another example, the heel reinforcement of an "over-pronator" may be sized and/or shaped differently from that of a wearer with a more neutral gait. In some embodiments, a heel reinforcement may be omitted. Midsole 200 further includes a plurality of transverse sipes 201, as discussed in more detail below in conjunction with FIG. 2E.

Midsole 200 is formed from a viscoelastic foam material. In at least some embodiments, midsole 200 is formed from a compressed ethylene vinyl acetate (EVA) foam. EVA foams are also known as phylon. In at least some such embodiments, and for portions of midsole 200 other than heel cup 202, the EVA foam may have properties in ranges such as are listed in Table 1.

TABLE 1

| Property | Unit | Min. | Max. |
|---|---|---|---|
| expansion ratio (mold cavity size to finished component size) | % | 189 | 191 |
| hardness (Asker C) | n/a | 36 | 40 |
| specific gravity | gr/cc | 0.1 | 0.12 |
| split tear strength | kg/cm | 1.2 | |
| compression set | % | | 60 |
| tensile strength | $kg/cm^3$ | 14 | |
| elongation | % | 250 | |
| tear strength | kg/cm | 7 | |
| shrinkage | % | | 2 |
| resiliency | % | 45 | |

Other materials could also be used for midsole 200. As but one example, in some embodiments a midsole may be formed from foam materials such as those used in the LUNAR family of footwear products available from NIKE, Inc. of Beaverton, Oreg. Additional examples of foam materials that can be used for midsole 200 include materials described in U.S. Pat. No. 7,941,938, which patent is hereby incorporated by reference herein. Other materials that can be used for midsole 200 include TPU and PU foams.

Figure 2E:
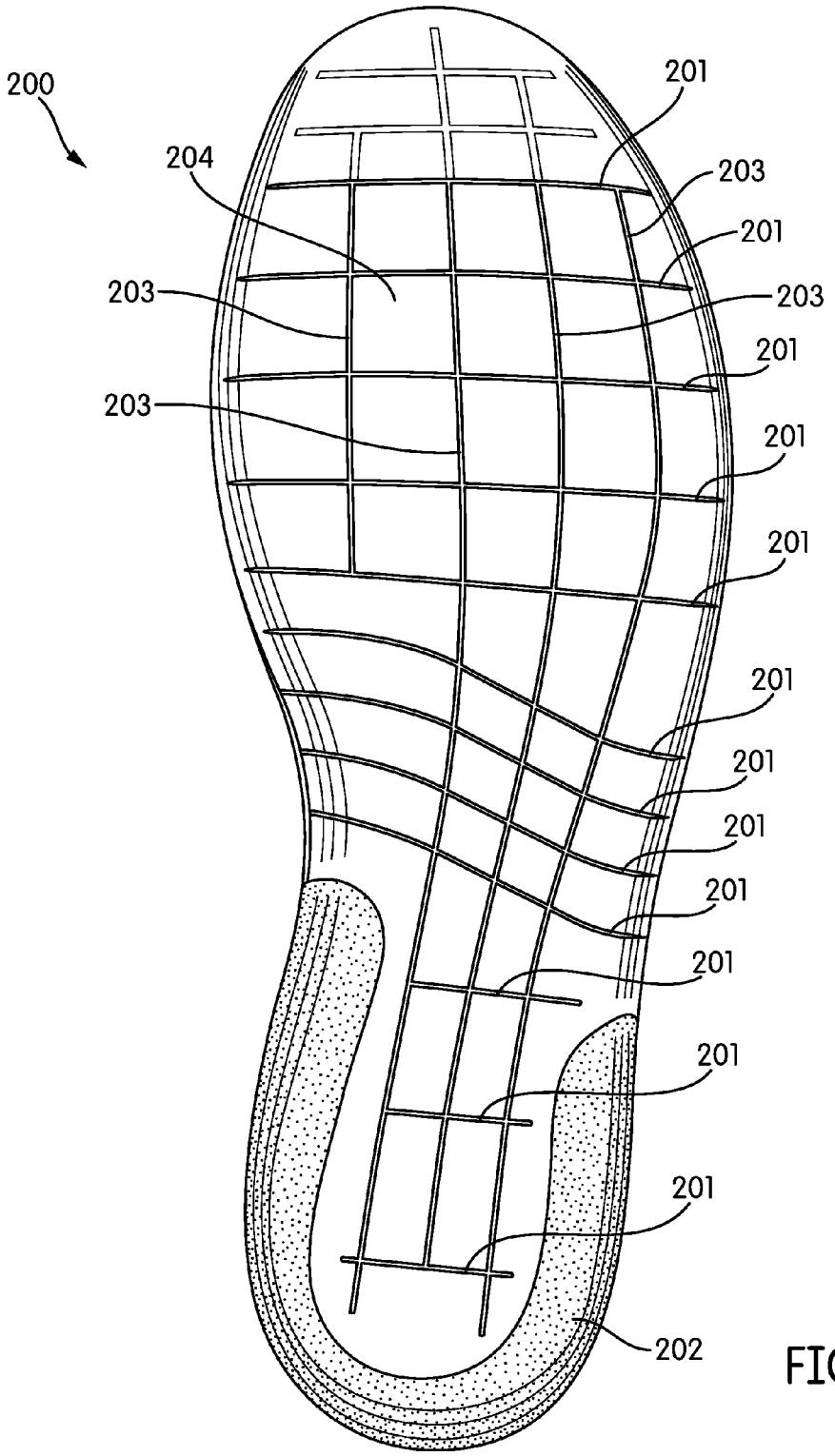
FIG. 2E is a bottom view of the midsole from the article of footwear of FIGS. 1A and 1B.

FIG. 2E is a bottom view of midsole 200. Midsole 200 includes transverse sipes 201 that extend at least partially between the lateral and medial sides. Longitudinal sipes 203 extend lengthwise along midsole 200. Sipes 201 and 203 create an articulated structure that imparts relatively high flexibility and articulation. In particular, sipes 201 and 203 define a plurality of elements (such as element 204) by exposing sides of those elements. By flexing along sipes 201 and 203, elements 204 can separate and move away from one another as a wearer walks, runs, etc. In some embodiments, midsole 200 may have a siping pattern such as is described for external midsoles in U.S. provisional patent application Ser. No. 61/632,837, filed Dec. 15, 2011, and titled "Articulated Sole Structure with Rearwardly Angled Mediolateral Midfoot Sipes," which application is incorporated by reference herein. Other siping patterns can also be used. Sipes 201 and 203 also allow for vertical displacement of elements 204 with respect to adjacent elements 204, e.g., to transmit vertical displacement of individual outsole lugs 112 through the midsole 200 to the plantar face of the wearer foot.

Figure 2F:
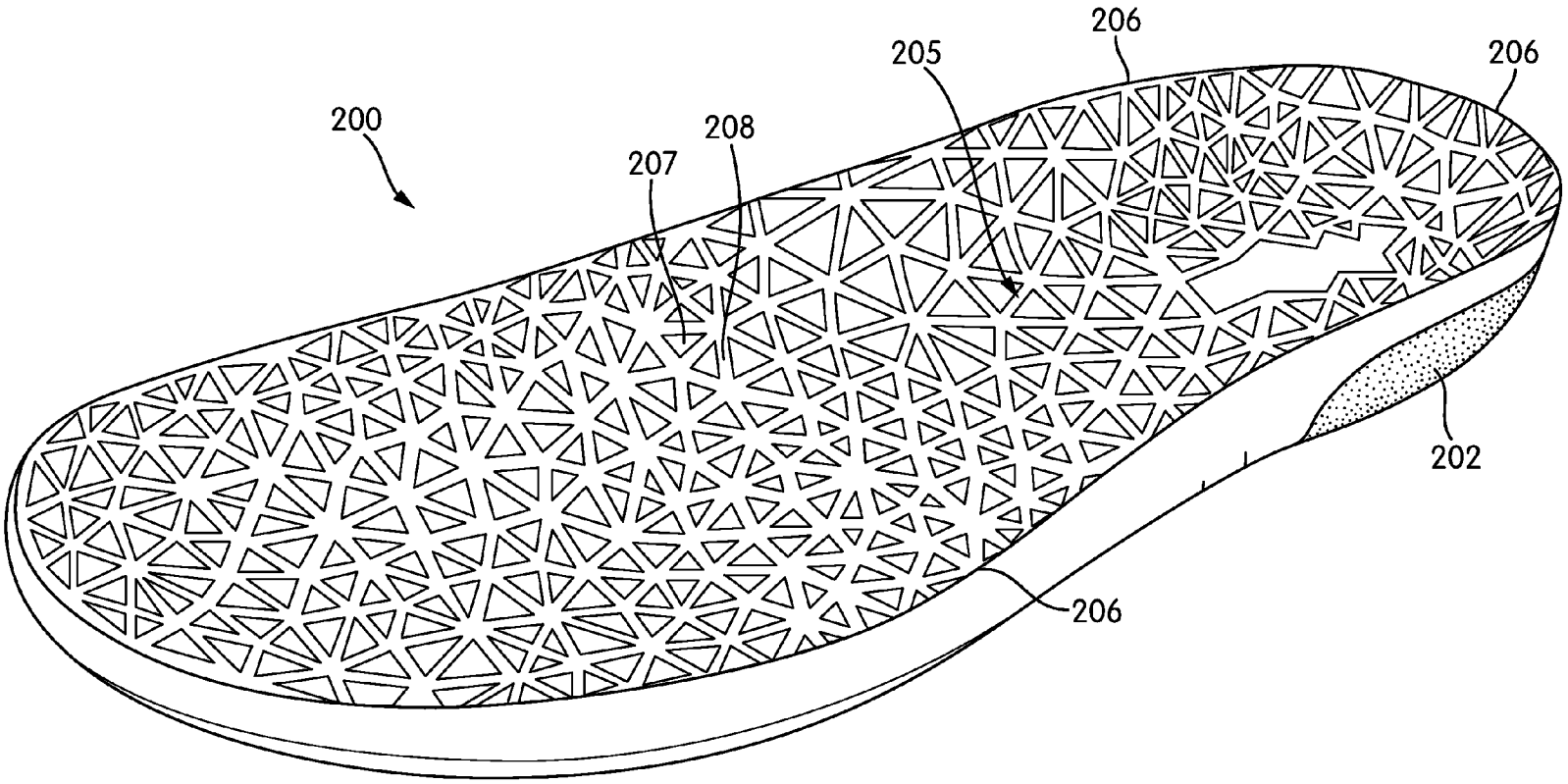
FIG. 2F is a top lateral front perspective view of the midsole from the article of footwear of FIGS. 1A and 1B.

FIG. 2F is a top lateral front perspective view of midsole 200. A top surface 205 is contoured to correspond to an underside of a foot of the shoe 100 wearer. Surface 205 is configured to act as a footbed and to receive the plantar face of a wearer foot. A raised edge 206 surrounds top surface 205. Edge 206 helps to stabilize midsole 200 within upper 101 and provides support to the sides of the wearer foot. Edge 206 is higher in the midfoot and heel portions of midsole 200 as compared to the forefoot portion.

Top surface 205 and the interior sides of edge 206 may have a pattern formed thereon so as to increase friction relative to the socked foot of a shoe 100 wearer. The pattern may comprise raised portions 207 that are separated by shallow channels 208. In some embodiments, raised portions 207 have heights (relative to the surrounding channels 208) of approximately 1 millimeter. Raised portions 207 cooperate with lugs 112 and help to transmit sensations of ground features to the underside of a wearer's foot. Channels 208 may further help to increase air flow to the underside of a wearer foot and permit greater moisture evaporation than would occur if top surface 205 were smooth.

Although the raised portions 207 comprises triangles in the embodiment of midsole 200, other shapes could be employed. In at least some embodiments, outsole lugs 112 and raised portions 207 are sized so that they are of approximately the same scale. In some embodiments, for example, an average of the cross sectional areas of outsole lugs is within a range of about 50% to about 200% of an average of the cross sectional areas of the raised portions. In some embodiments, an average of the cross sectional areas of outsole lugs is within a range of about 20% to about 500% of an average of the cross sectional areas of the raised portions. In certain embodiments, the outsole lugs and the midsole raised portions are sized so that the number of lugs along a first path crossing the outsole in a transverse direction is within a range of about 50% to about 200% of the number of raised portions located on along a second transverse path that crosses the midsole and is directly above the first transverse path. In some embodiments, the number of lugs along a first path crossing the outsole in a transverse direction is within a range of about 20% to about 500% of the number of raised portions located on along a second transverse path directly above the first transverse path. In some embodiments, the pattern of raised portions on a midsole top surface may correspond to or otherwise correlate with a pattern of lugs on the outsole of a shoe containing that midsole.

Figure 3A:
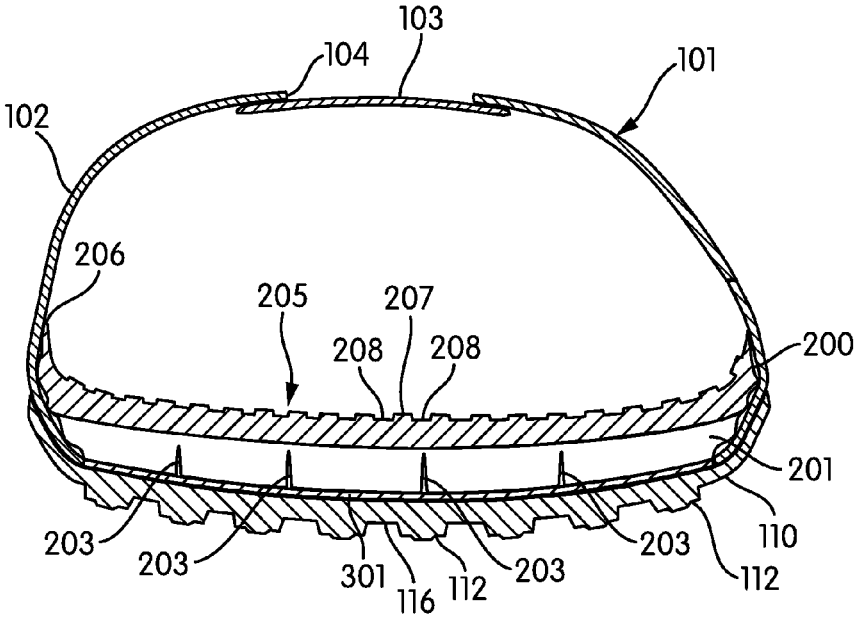
FIGS. 3A and 3B are area cross-sectional views taken from the location indicated in FIG. 1A.
Figure 3B:
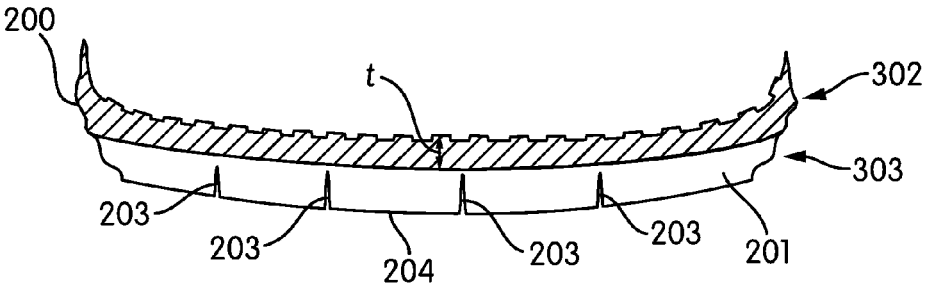

FIG. 3A is an area cross-sectional view of shoe 100 from the location indicated in FIG. 1A. As can be seen in FIG. 3A, the bottom (and exterior) face of midsole 200 rests directly on the top (and interior) face of lasting element 301. The cross-sectional plane of FIG. 3A is parallel to one of the transverse sipes 201 in midsole 200 and shows the intersection of the four longitudinal sipes 203 with that transverse sipe 201. FIG. 3B is similar to FIG. 3B, but only shows an area cross-sectional view of midsole 200. As indicated in FIG. 3B, midsole 200 includes a spanning portion 302 and an articulated portion 303. The boundaries of spanning portion 302 and articulated portion 303 are only approximately indicated in FIG. 3B. Articulated portion 303 includes a plurality of elements 204 formed by sipes 201 and 203. Spanning portion 302 includes portions of midsole 200 above sipes 201 and 203. Elements 204 are connected to (e.g., integrally formed with) and extend downward from spanning portion 302.

Sipes in midsole 200 can be formed by cutting those sipes after midsole 200 has been molded. Such cutting can be performed using a hot knife tool, a laser or other cutting device. In some embodiments, sipes may be formed during molding of a midsole, e.g., by including blades in a midsole mold that correspond to desired sipe locations. In some embodiments, sipes are formed so that spanning portion 302 has a thickness t above the sipes of approximately 3 millimeters. In some embodiments, a portion of a midsole configured to lie under a wearer forefoot has a total thickness between about 3 millimeters and about 6 millimeters. In some such embodiments having thinner midsoles, sipes may be of reduced depth or absent.

In at least some embodiments, midsole 200 lacks a top cloth or other liner element applied to surface 205. In this way, the wearer foot (perhaps covered by a sock) rests directly on an exposed surface of the foam that forms midsole 200. The absence of a top cloth also helps increase the degree to which details about the ground surface are transmitted vertically through the sole structure and felt by the underside of a wearer foot. If a top cloth were adhered to surface 205, that top cloth would apply a tensile force tending to resist deformation of midsole 200 as a wearer moves. That tensile force would moderate the degree to which midsole 200 could transfer pressure to the wearer foot from individual lugs 112, thereby reducing the definition with which a user is able to sense features of the ground.

In some embodiments, a midsole may have additional elements added to a top surface such as surface 205. In at least some such embodiments, however, those additional elements only span a limited portion of the midsole top surface. For example, individual features such as triangles 207 might have a covering, but such covering may not span gaps (such as channels 208) between such features. Additionally or alternatively, if desired, a partial top cloth or liner element could be provided (even one spanning some gaps or channels 208) in areas of the foot where the transmission of pressure through the sole structure is less useful or desired.

Figure 3C:
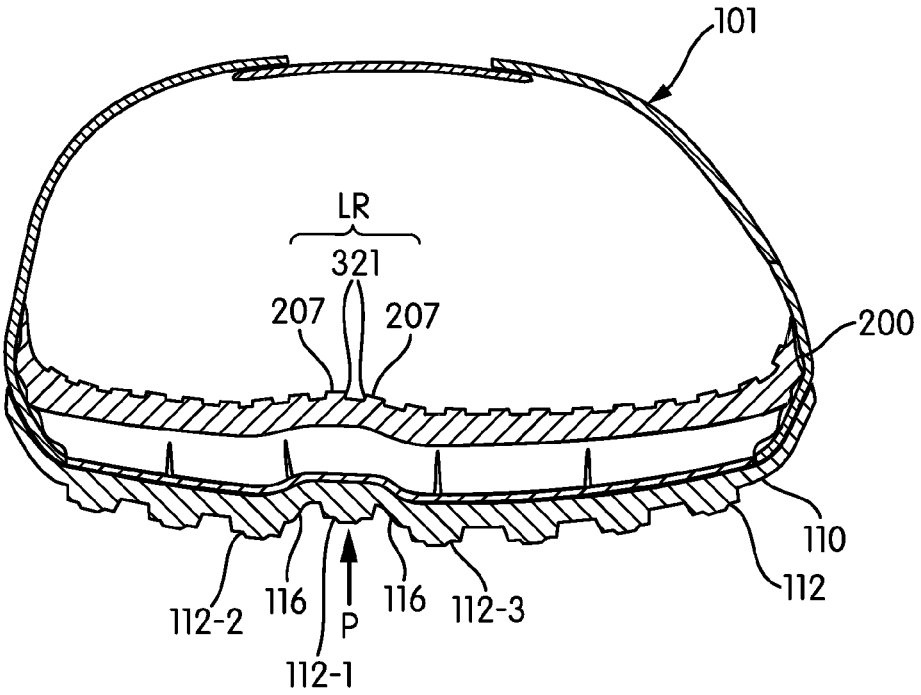
FIG. 3C is an area cross-sectional view similar to FIG. 3A, but showing transfer of localized pressure.

FIG. 3C is an area cross sectional view of shoe 100 taken from the same location as the view of FIG. 3A. In FIG. 3C, however, the effect of a localized upward pressure P is illustrated. Upward pressure P may result, e.g., from a wearer of shoe 100 stepping on a rock, a tree root or some other object as the wearer is running. Pressure P pushes one or more of lugs 112 upward. For convenience, that lug is labeled 112-1 and two adjacent lugs are labeled 112-2 and 112-3. Because of the flexibility of outsole 110 afforded by the thin regions of gaps 116, lug 112-1 is able to move upward while only minimally affecting adjacent lugs 112-2 and 112-3.

The upward pressure P on lug 112-1 is transferred to the underside of midsole 200. Although the foam of midsole 200 compresses somewhat (thereby absorbing some of the energy from pressure P), the localized region LR of midsole 200 over lug 112-1 is also moved upward. The underside of the wearer foot senses this pressure in region LR. As a result, the shoe 100 wearer can realize that he or she has stepped on an object in this region. The combination of discrete lugs 112, highly flexible gaps 116 and midsole 200 allows the shoe 100 wearer to sense the presence of a ground object with more definition than would may be possible with many conventional footwear designs. These features also allow the wearer to sense and feel the contours or slope of the ground surface, even if not stepping on a foreign object.

FIG. 3C also illustrates how raised regions 207 of midsole 200 may help increase the definition with which a shoe 100 wearer senses objects and/or ground contours. As midsole 200 is moved upward, the portion of surface 205 in region LR becomes bowed. This may cause edges 321 of raised regions 207 to become more prominent and to create more localized pressures on portions of the wearer foot.

Figure 4A:
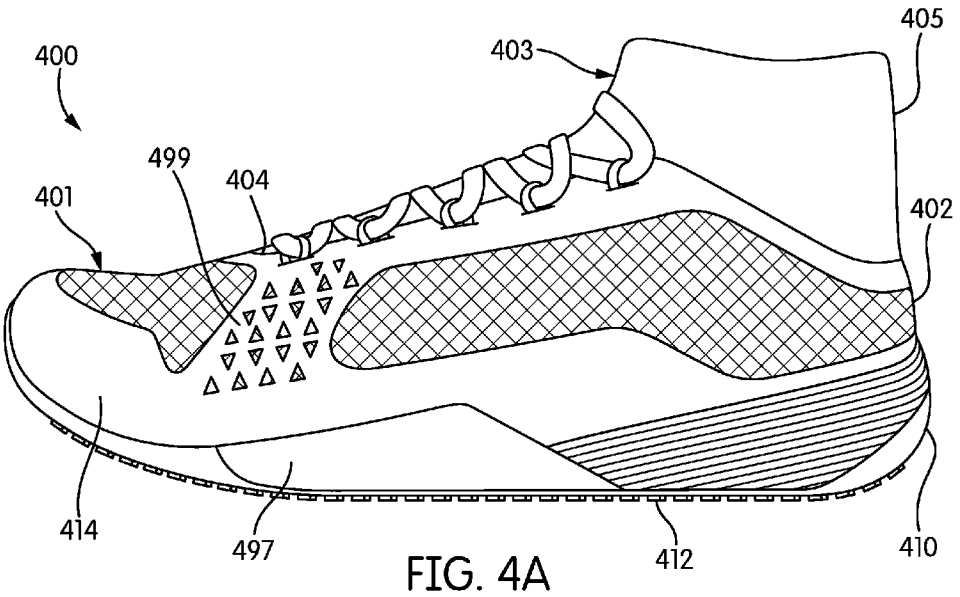
FIGS. 4A and 4B are respective lateral and medial side views of an article of footwear according to some additional embodiments.
Figure 4B:
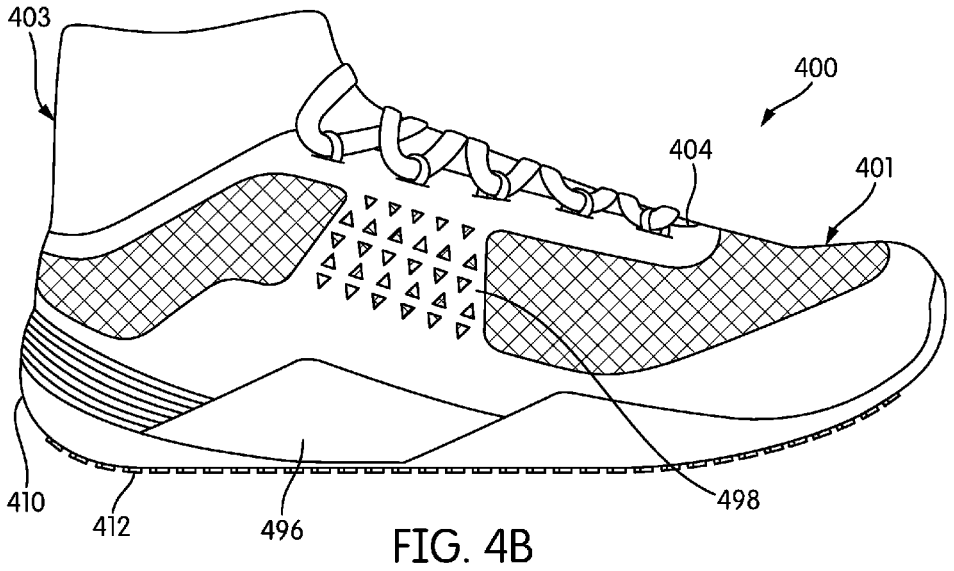

FIGS. 4A and 4B are lateral and medial side views of a shoe 400 according to some additional embodiments. Shoe 400 includes an upper 401 that is similar to upper 101 of shoe 100 and that may be formed in a manner similar to that of upper 101. Like upper 101, upper 401 also includes a mesh panel 402 and a partial sock 403. Partial sock 403 is also formed from a partially elastic woven material and includes an ankle collar 405 similar to ankle collar 105. Partial sock 403 is joined to mesh panel 402 in a manner similar to that in which partial sock 103 is joined to mesh panel 102 (e.g., by stitching, fusing techniques, etc.). Upper 401 differs from upper 101 in several respects, however. For example, the portion of mesh panel 402 surrounding the heel region extends less far upward than the similar heel region of mesh panel 102. The skin panel 414 of this example structure also has a different configuration than skin panel 114 of mesh panel 102. Notably, skin panel 414 includes panels 499 and 498 that extend upward to lacing opening 404. In some embodiments, mesh panel 402 may include a counter or other support element in a heel region (e.g., as a separate component inside, outside, and/or engaged with mesh panel 402).

Shoe 400 further includes an outsole 410 that is similar to outsole 110 of shoe 100. In particular, outsole 410 is thin, highly flexible and bonded directly to a lasting element (not shown) of upper 401. Outsole 410 further includes a plurality of discrete lugs 412. Unlike outsole 110, however, outsole 410 includes a more raised lateral edge 497 and a more raised medial edge 496. Edges 496 and 497 provide increased lateral and arch support, respectively.

Figure 4C:
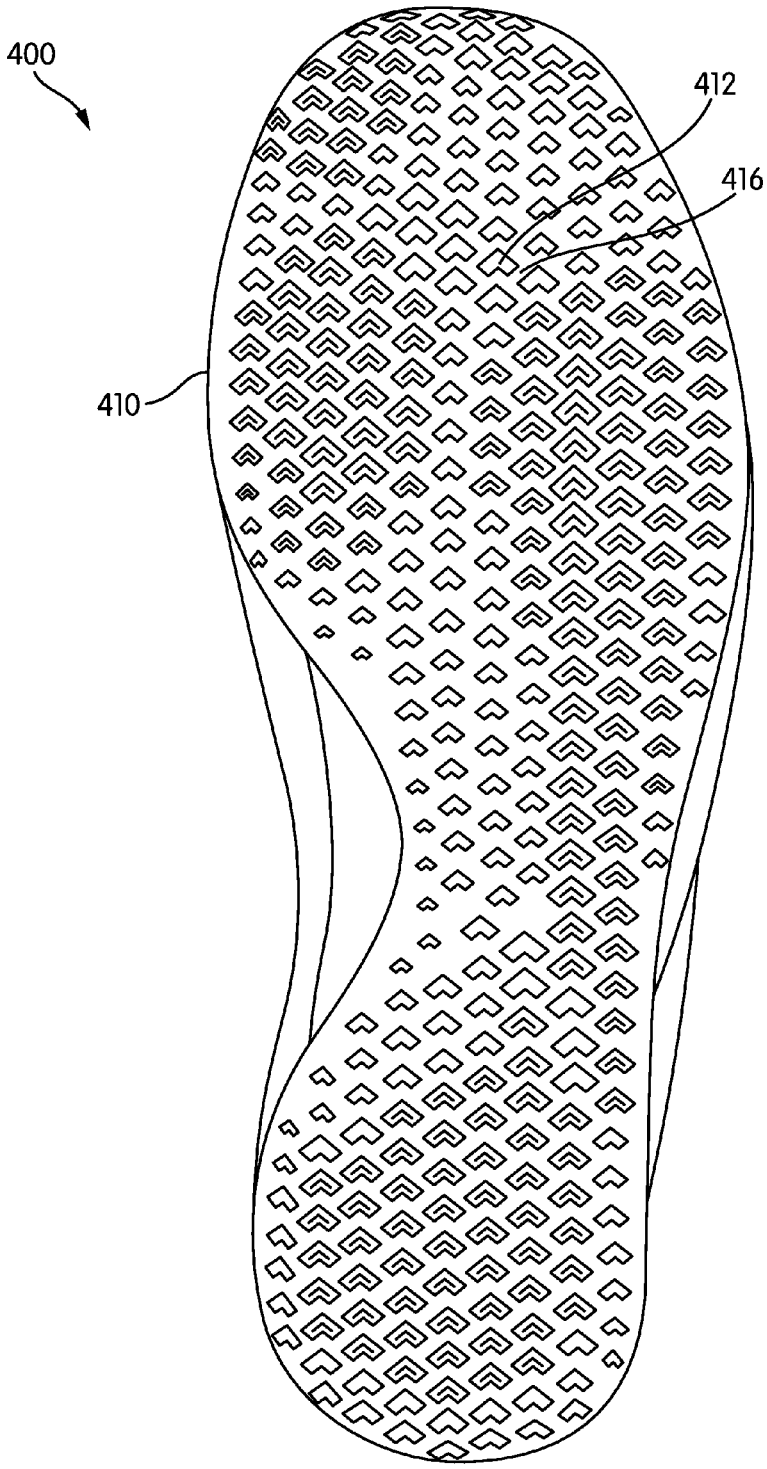
FIG. 4C is a bottom view of the article of footwear of FIGS. 4A and 4B.

FIG. 4C is a bottom view of shoe 100 and shows additional details of the bottom exterior surface of outsole 410. Similar to outsole 110, outsole 410 includes multiple discrete lugs 412. Lugs 412 are small relative to the area of the outsole 410 ground contact surface and are separated from one another by gaps 416. As with lugs 112 of outsole 110, the height and cross-sectional areas of lugs 412 may vary based on location, as may the separation between lugs 412.

Figure 5A:
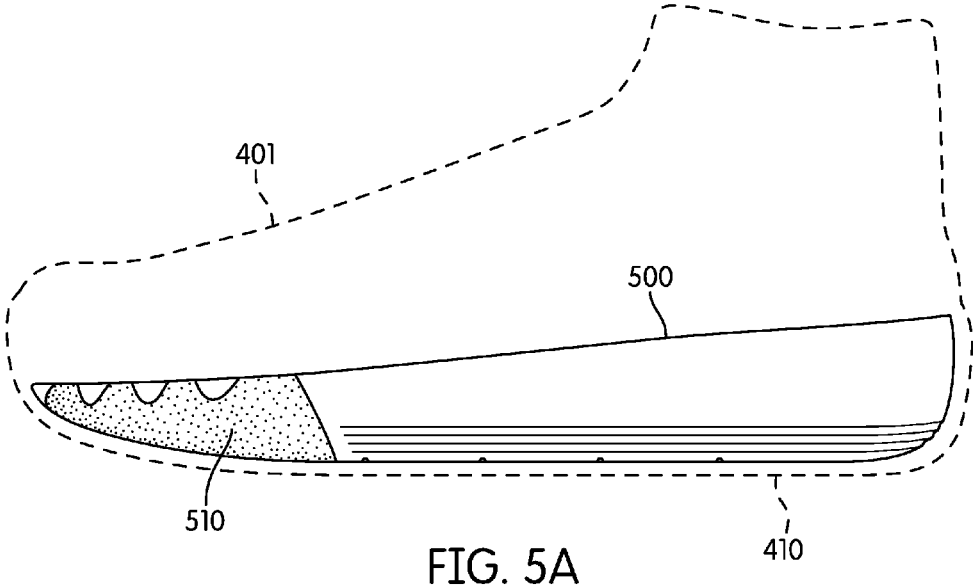
FIGS. 5A through 5D are lateral side, medial side, front and rear views, respectively, of a midsole from the article of footwear of FIGS. 4A and 4B.
Figure 5B:
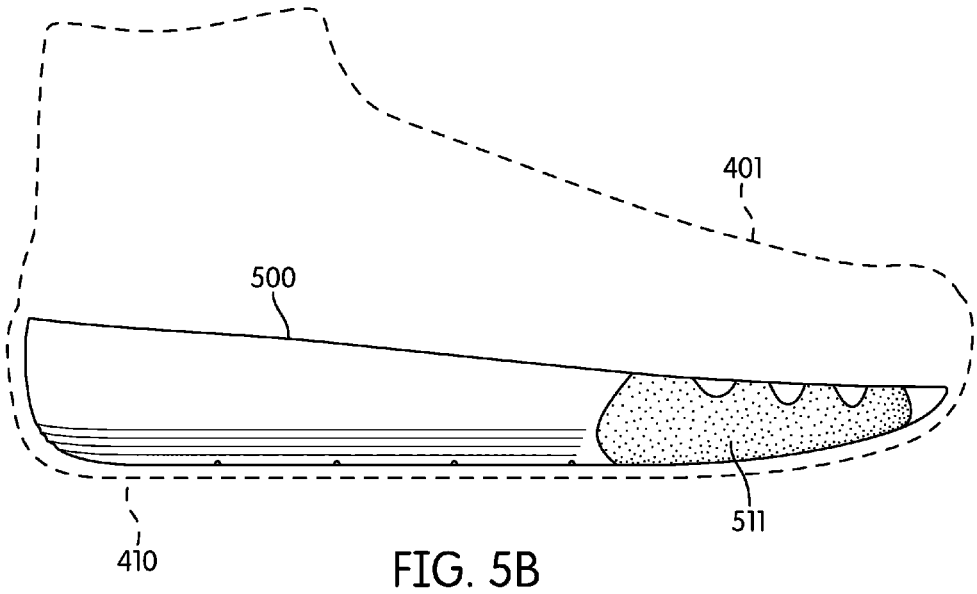
Figure 5C:
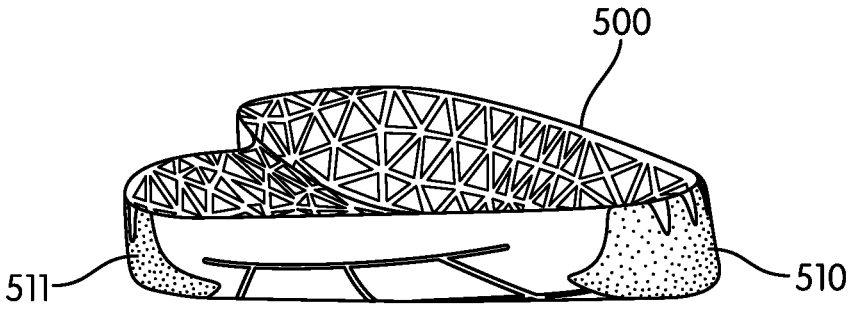
Figure 5D:
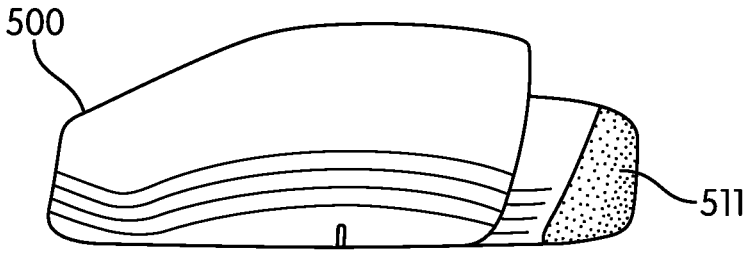

FIGS. 5A and 5B are respective lateral and medial side views of a midsole 500 of shoe 400. FIGS. 5C and 5D are respective front and rear views of midsole 500. So as to generally show the position of midsole 500 within shoe 400, upper 401 and outsole 410 are approximately indicated with broken lines in FIGS. 5A and 5B. Midsole 500 may be formed of materials such as those described in connection with midsole 200. Like midsole 200, midsole 500 attenuates ground reaction forces and absorbs energy. Midsole 500 is not permanently attached to upper 401 or to outsole 410 and can be nondestructively removed from shoe 400 through the opening of ankle collar 405.

Midsole 500 includes a forefoot lateral reinforcement 510 and a forefoot medial reinforcement 511. Reinforcements 510 and 511, which may be formed from higher density and less compressible foams similar to heel reinforcement 202 of midsole 200, help to stabilize a wearer forefoot. In the embodiment of shoe 400, midsole 500 lacks a heel reinforcement (although one could be provided, if desired). Reinforcements 510 and 511 (as well as 202) also may be separately formed components that are engaged with the foam of the midsole components (e.g., via cements or adhesives, mechanical connectors, etc.).

Figure 5E:
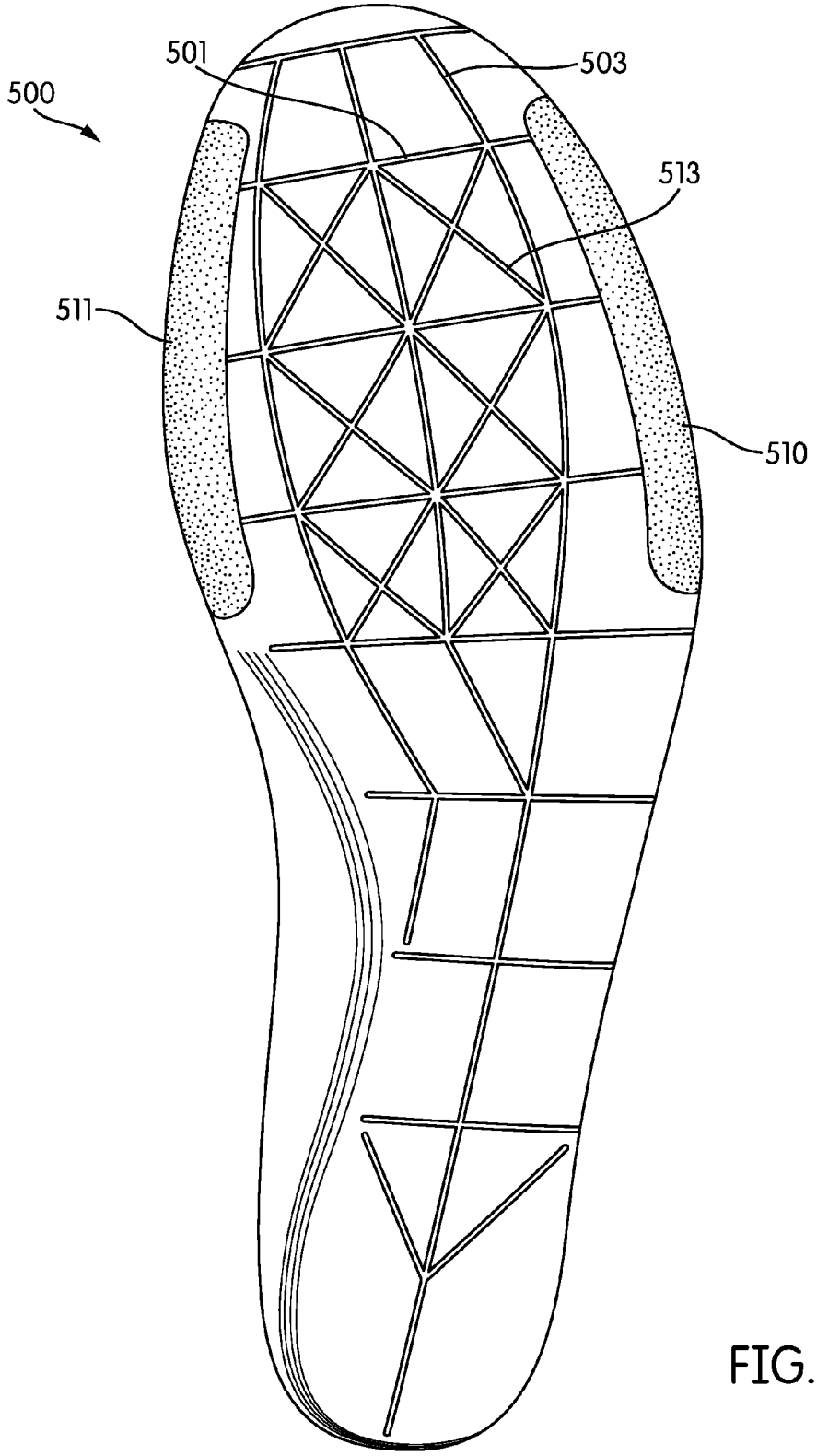
FIG. 5E is a bottom view of the midsole from the article of footwear of FIGS. 4A and 4B.

FIG. 5E is a bottom view of midsole 500. Midsole 500 also includes a plurality of transverse sipes 501 and longitudinal sips 503, and further includes diagonal sipes 513. In the embodiment of shoe 500, however, sipes 501, 503 and 513 are relatively shallow by comparison to sipes of midsole 200.

Figure 5F:
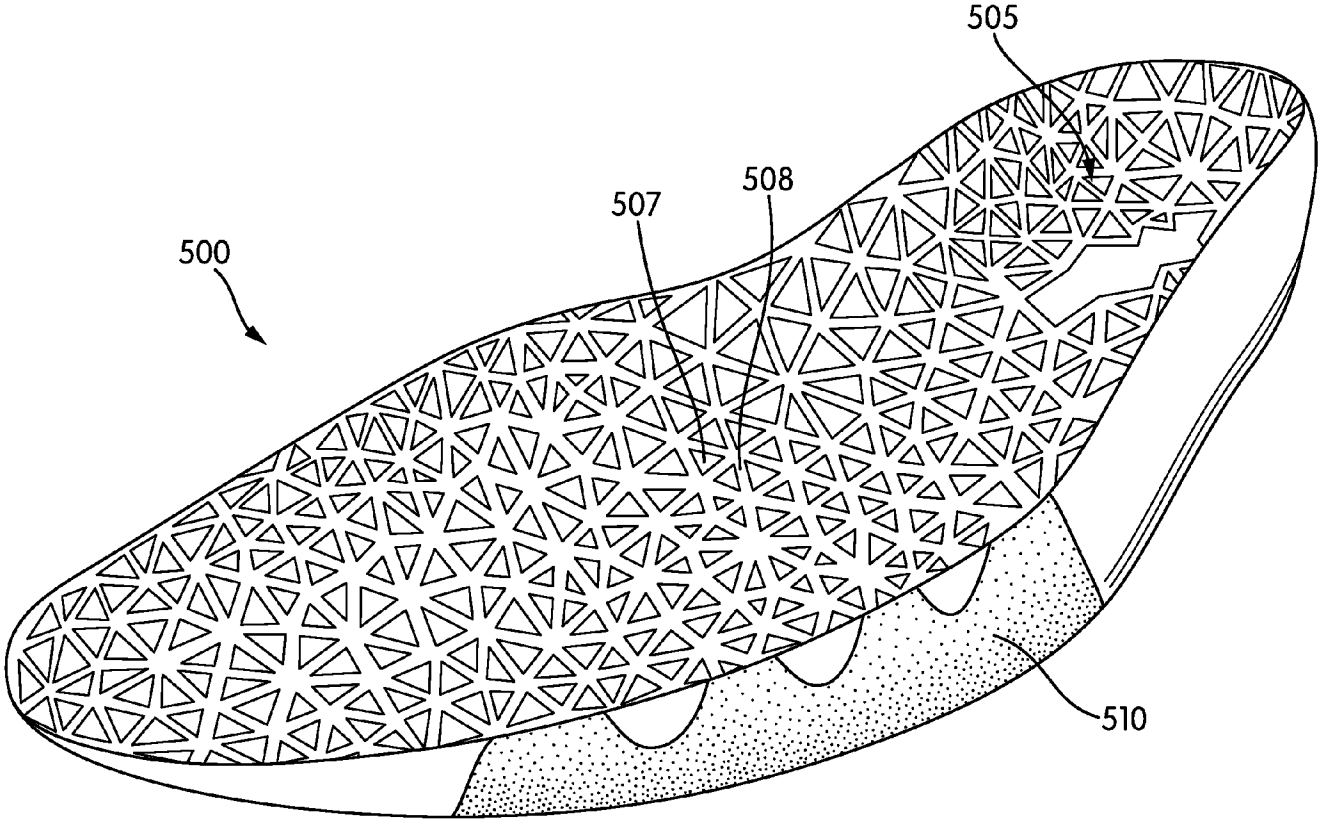
FIG. 5F is a top lateral front perspective view of the midsole from the article of footwear of FIGS. 4A and 4B.

FIG. 5F is a top lateral front perspective view of midsole 500. A top surface 505 of midsole 500 includes a plurality of raised regions 507 separated by channels 508. Raised regions 507, which may have heights of approximately 1 millimeter, provide benefits similar to those provided by raised regions 207 of midsole 200. As with midsole 200, the raised regions 507 of midsole 500 and the lugs 412 of outsole 410 are sized so that they are of approximately the same scale. The top surface 505 of midsole 500 may also lack a top cloth or other liner element.

Figure 6A:
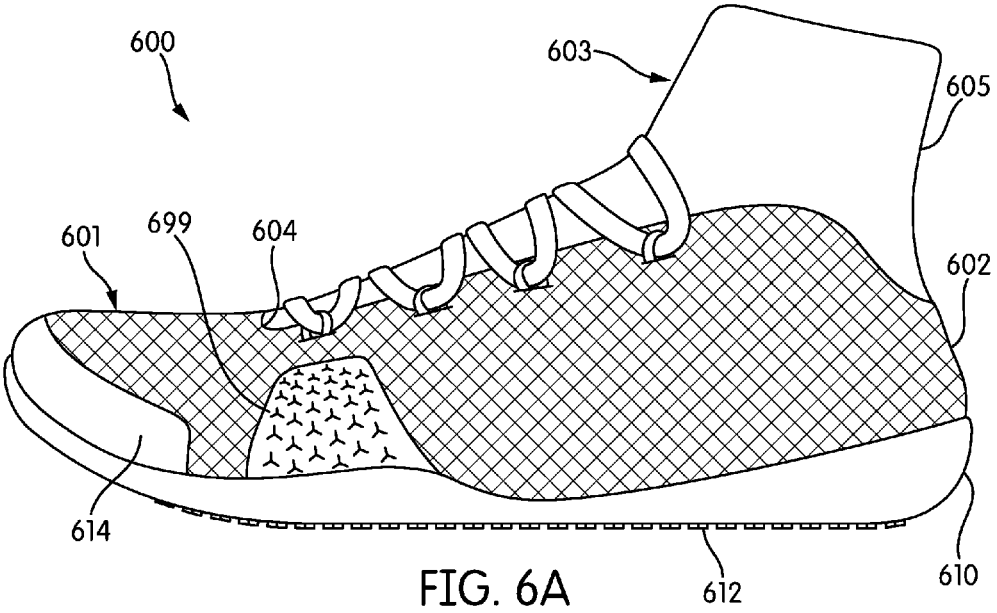
FIGS. 6A and 6B are respective lateral and medial side views of an article of footwear according to some further embodiments.
Figure 6B:
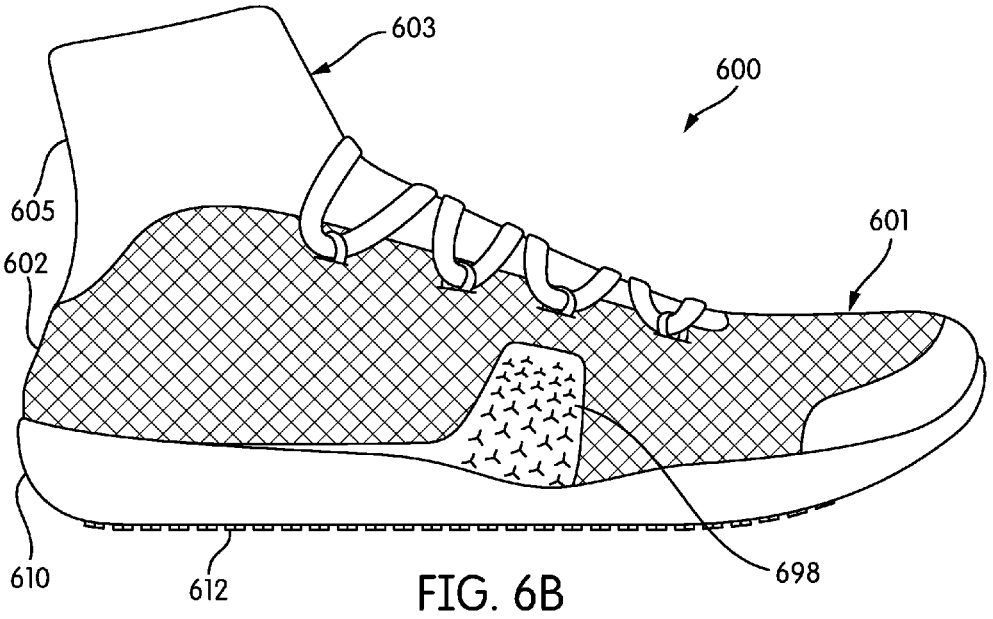

FIGS. 6A and 6B are lateral and medial side views of a shoe 600 according to some further embodiments. Shoe 600 includes an upper 601 that is similar to upper 101 of shoe 100 and that may be formed in a manner similar to that of upper 101. Like upper 101, upper 601 includes a mesh panel 602 and a partial sock 603. Partial sock 603 is also formed from a partially elastic woven material and includes an ankle collar 605 similar to ankle collar 105. Partial sock 603 is joined to mesh panel 602 in a manner similar to that in which partial sock 103 is joined to mesh panel 102. Upper 601 differs from upper 101 in several respects. For example, and similar to upper 401 of shoe 400, the skin panel 614 of mesh panel 602 includes panels 699 and 698 that extend upward toward lacing opening 604. In some embodiments, panel 699 and/or panel 698 may extend all the way to opening 604 and/or may include portions (e.g., formed from a thinner and/or different color material) that extend all the way to opening 604.

Shoe 600 includes an outsole 610. Like outsole 110 of shoe 100, outsole 610 is thin, highly flexible and bonded directly to a lasting element (not shown) of upper 601. Outsole 610 further includes a plurality of discrete lugs 612.

Figure 6C:
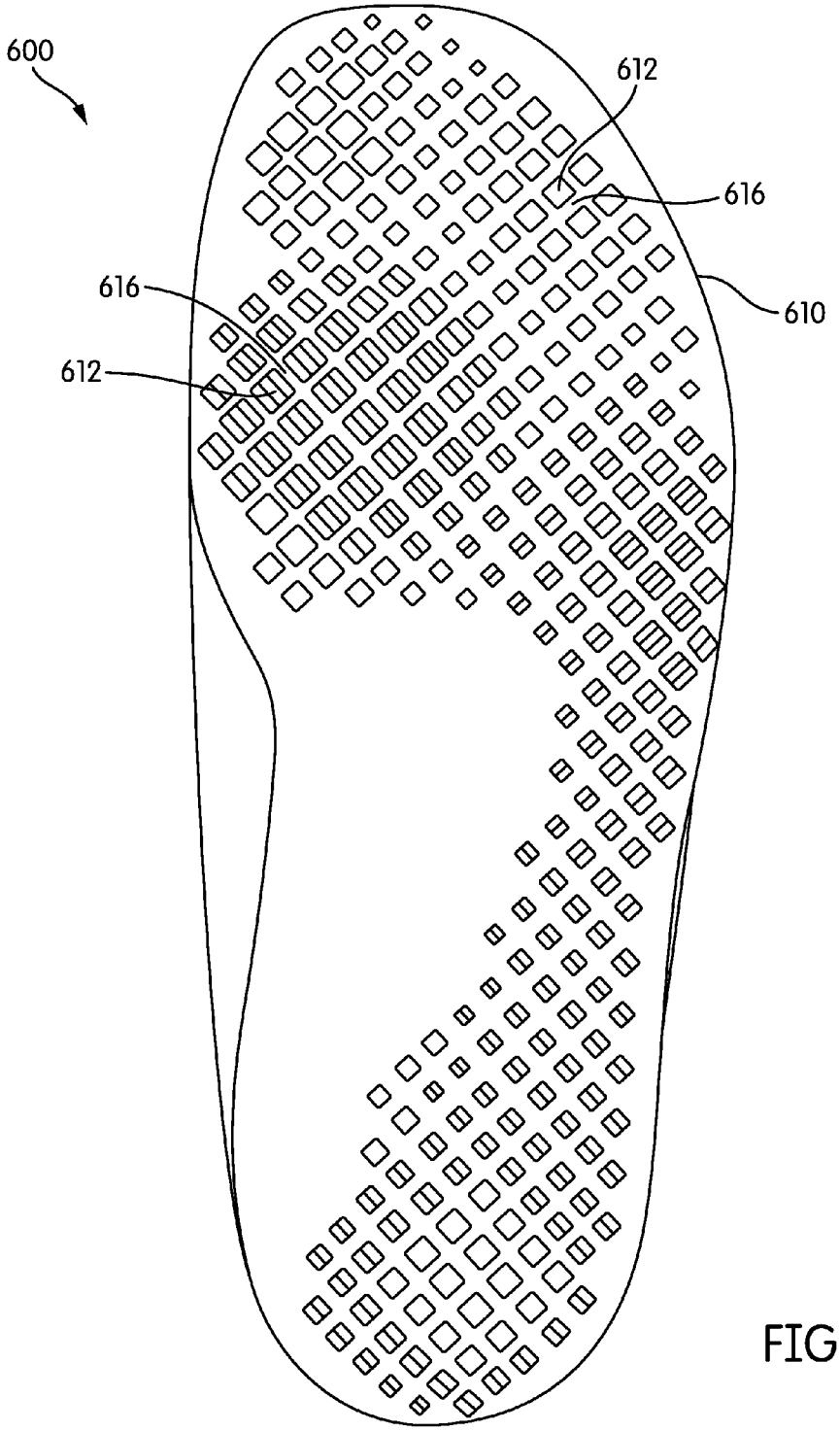
FIG. 6C is a bottom view of the article of footwear of FIGS. 6A and 6B.

FIG. 6C is a bottom view of shoe 600 and shows additional details of the bottom exterior surface of outsole 610. Similar to outsole 110, outsole 610 includes multiple discrete lugs 612. Lugs 612 are small relative to the area of the outsole 610 ground contact surface and are separated from one another by gaps 616. As with lugs 112 of outsole 110, the height and cross-sectional areas of lugs 612 may vary based on location, as may the separation between lugs 612.

Figure 7A:
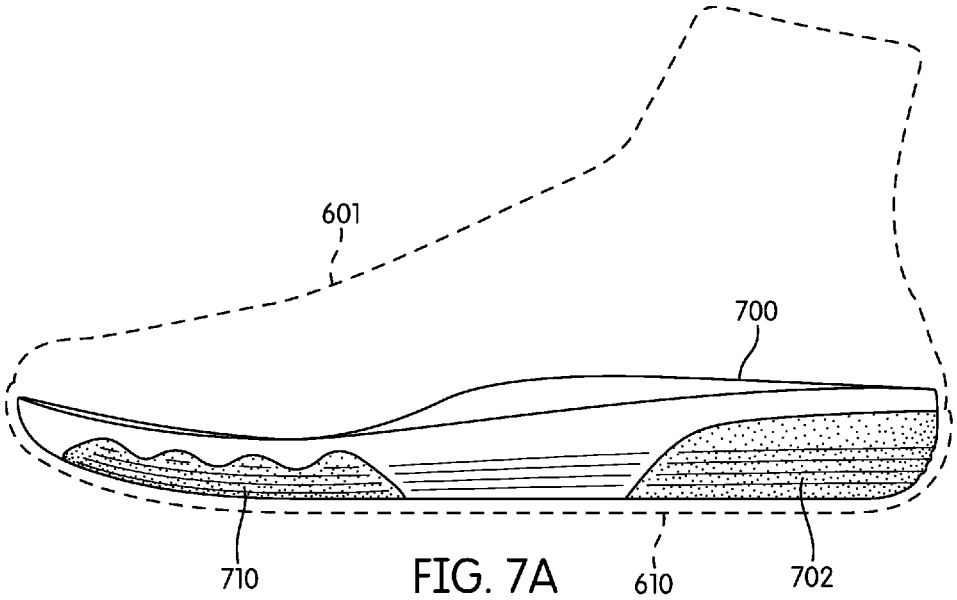
FIGS. 7A through 7D are lateral side, medial side, front and rear views, respectively, of a midsole from the article of footwear of FIGS. 6A and 6B.
Figure 7B:
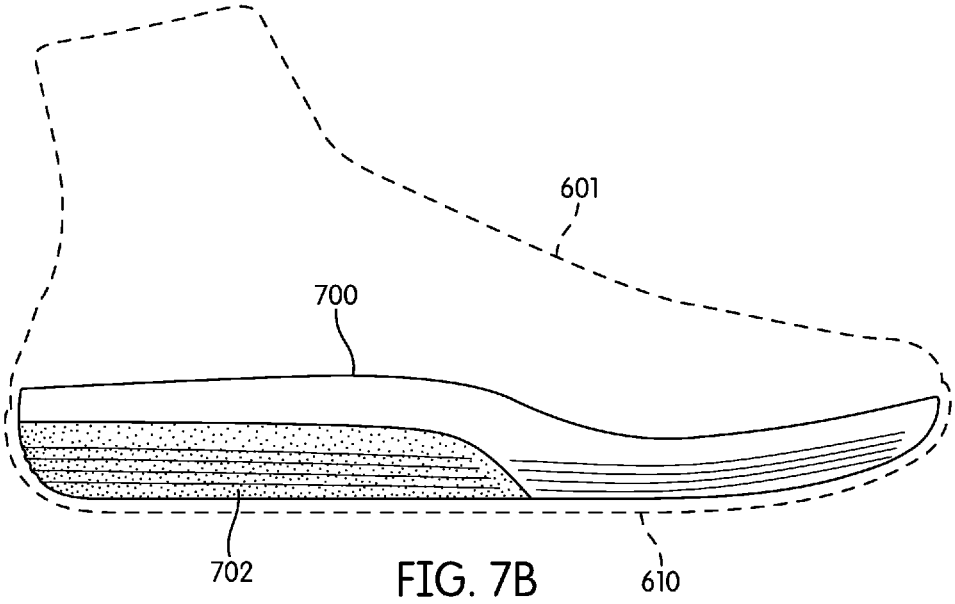
Figure 7C:
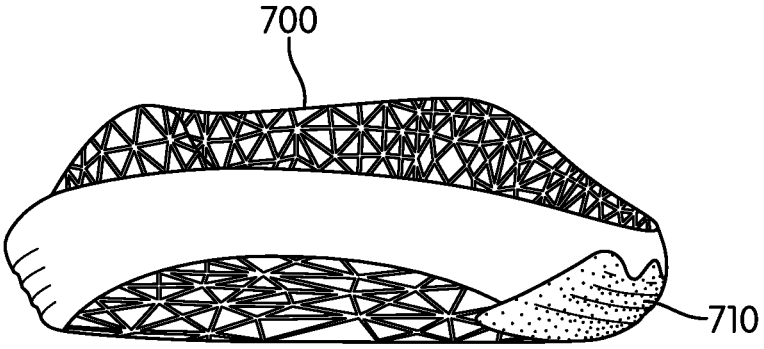
Figure 7D:
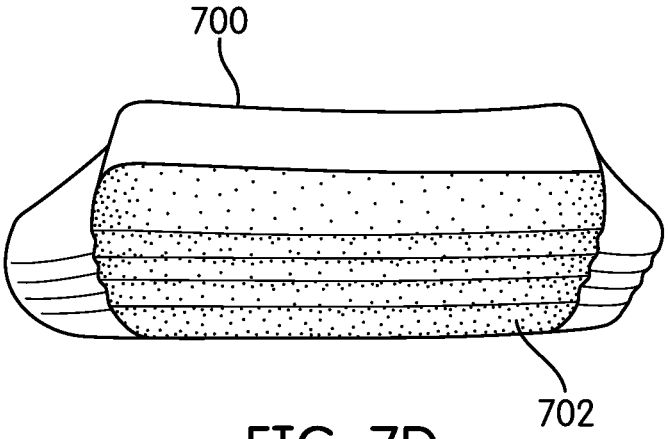

FIGS. 7A and 7B are respective lateral and medial side views of a midsole 700 of shoe 600. FIGS. 7C and 7D are respective front and rear views of midsole 700. So as to generally show the position of midsole 700 within shoe 600, upper 601 and outsole 610 are approximately indicated with broken lines in FIGS. 7A and 7B. Midsole 700 may be formed of materials such as those described in connection with midsole 200. Like midsole 200, midsole 700 attenuates ground reaction forces and absorbs energy. Midsole 700 is not permanently attached to upper 601 or to outsole 610 and can be nondestructively removed from shoe 600 through the opening of ankle collar 605.

Midsole 700 includes a forefoot lateral reinforcement 710 and a heel reinforcement 702. Reinforcements 702 and 710, which may be formed from higher density and less compressible foams similar to heel reinforcement 202 of midsole 200, help to stabilize a wearer forefoot and heel.

Figure 7E:
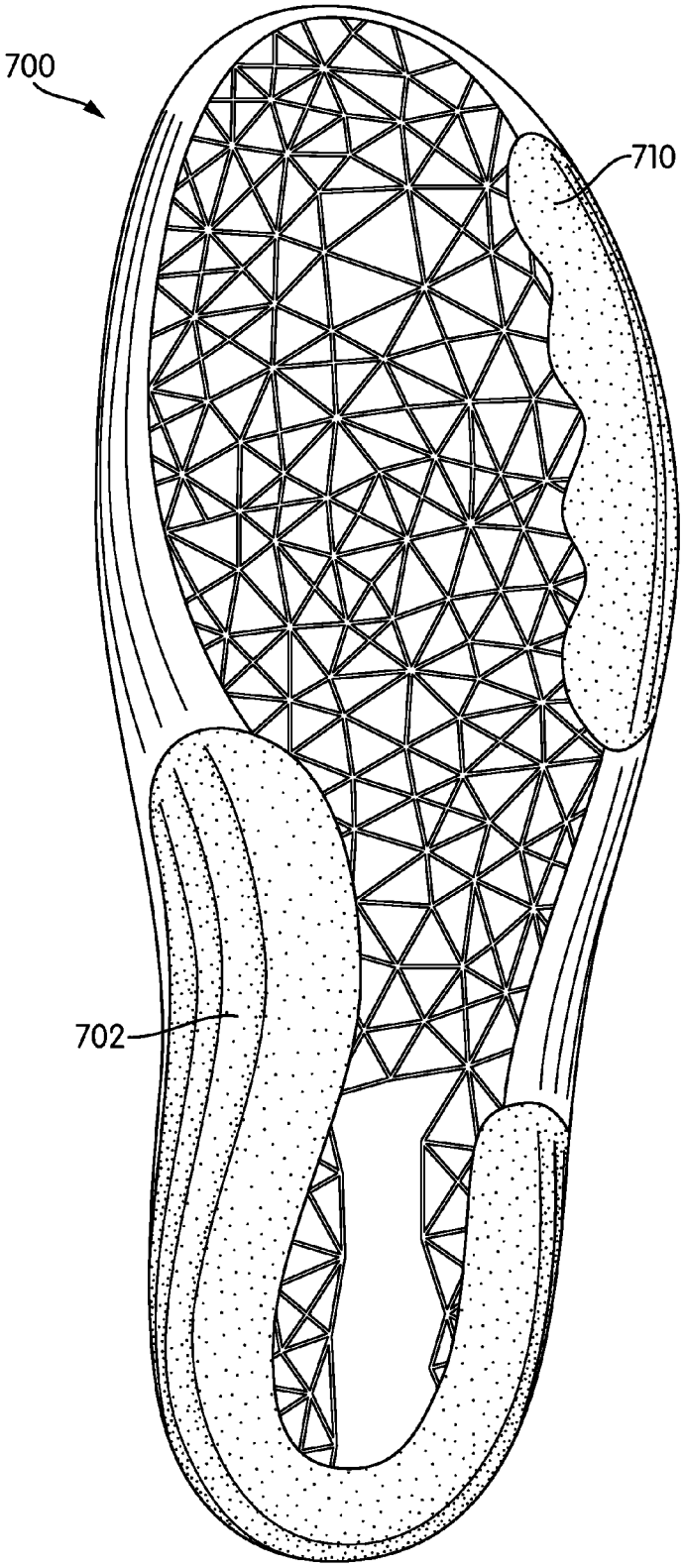
FIG. 7E is a bottom view of the midsole from the article of footwear of FIGS. 6A and 6B.
Figure 7F:
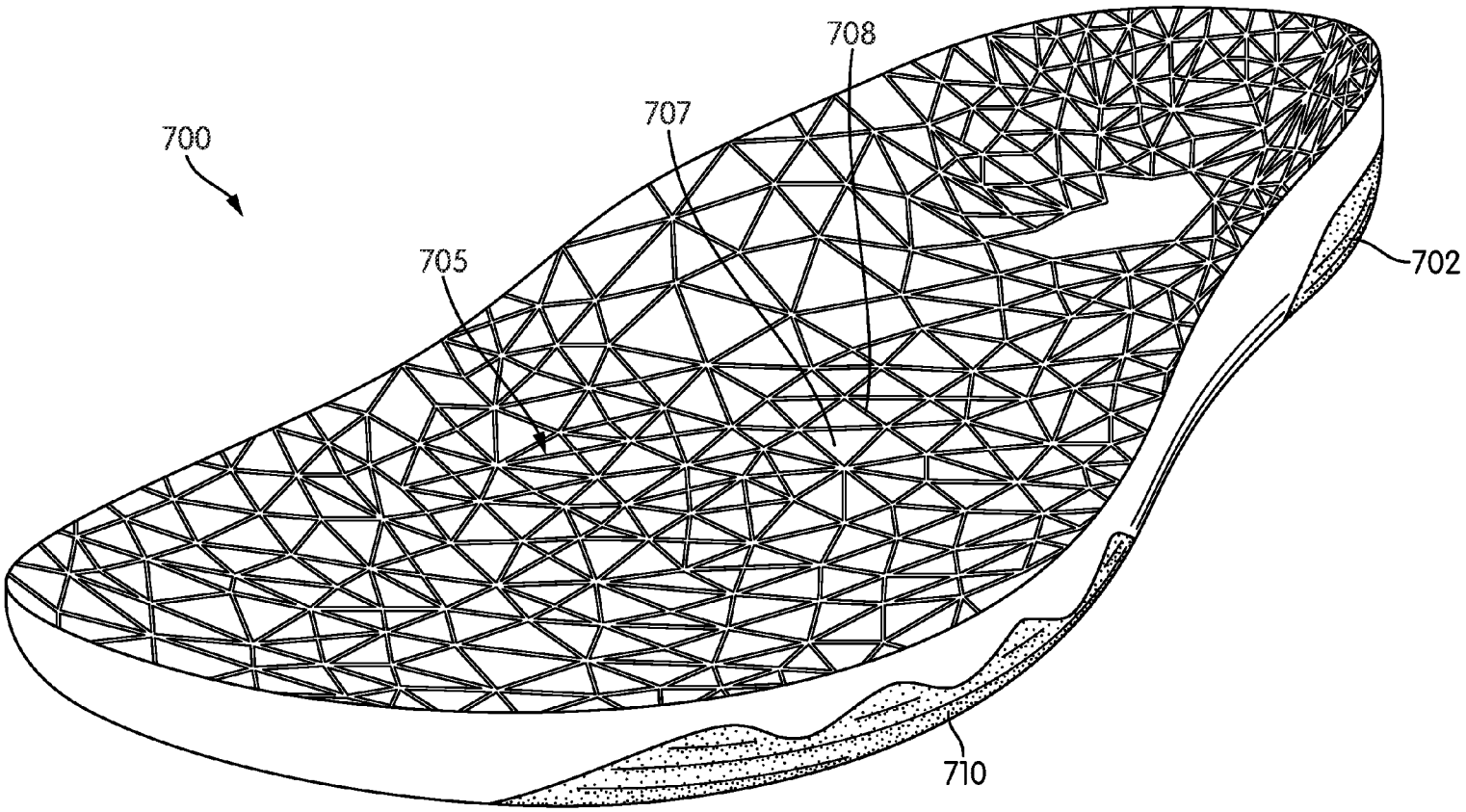
FIG. 7F is a top lateral front perspective view of the midsole from the article of footwear of FIGS. 6A and 6B.

FIG. 7E is a bottom view of midsole 500. Instead of sipes, the bottom surface of midsole 700 includes a pattern of grooves similar to the channels between raised portions on the top surface of midsole 700. Those channels can be seen in FIG. 7F, a top lateral front perspective view of midsole 700. A top surface 705 of midsole 700 includes a plurality of raised regions 707 separated by channels 708. Raised regions 707, which may have heights of approximately 1 millimeter, provide benefits similar to those provided by raised regions 207 of midsole 200. As with midsole 200, the raised regions 707 of midsole 700 and the lugs 612 of outsole 610 are sized so that they are of approximately the same scale. The top surface 705 of midsole 700 may also lack a top cloth or other liner element.

In some embodiments, shoes having outsoles and/or midsoles such as those of shoes 100, 400 and 600, as well as shoes having outsoles and/or midsoles according to other embodiments, may have an upper such as is described in commonly-owned U.S. patent application Ser. No. 13/681,842 (filed Nov. 20, 2012, and titled "Footwear Upper Incorporating A Knitted Component With Collar And Throat Portions"), which application in its entirety is incorporated by reference herein.

In some embodiments, only some portions of an outsole may include discrete lugs separated by gaps, with the outsole thickness in those gaps being relatively thin. For example, some embodiments may include an outsole in which some or all of the forefoot region is similar to the forefoot region of outsole 110, of outsole 410 or of outsole 610, but in which the heel region is substantially thicker and/or lacks discrete lugs.

In some embodiments, a shoe may include an outsole that is slightly thicker and/or that may include an additional midsole element. For example, a rubber outsole may be bonded to a relatively thin external midsole formed from EVA or other compressible material, with that external midsole in turn bonded to a lasting element of an upper. The outsole and external midsole may still be relatively thin so as to, e.g., permit individual lugs on the outsole to exert upward pressure independently of adjacent lugs. In some such embodiments, a removable internal midsole similar to midsoles described above (e.g., midsole 200, 500 and/or 700) may also be included.

As previously indicated, upper 101 and uppers shown in other drawings, outsole 110 and outsoles shown in other drawings, and midsole 200 and midsoles shown in other drawings are merely exemplary. There are innumerable additional embodiments in which an upper, outsole and/or midsole may be functionally similar to an upper, outsole or midsole as described herein, but which may have a different visual appearance.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from above-described embodiments are the within the scope of the invention. With regard to claims directed to an apparatus, an article of manufacture or some other physical component or combination of components, a reference in the claim to a potential or intended wearer or a user of a component does not require actual wearing or using of the component or the presence of the wearer or user as part of the claimed component or component combination.

The invention claimed is:

1. An article of footwear, comprising:

an upper, the upper including a lasting element;

an outsole formed of a synthetic rubber material bonded directly to an exterior face of the lasting element, wherein the outsole comprises multiple discrete lugs distributed across a bottom exterior surface of the outsole in forefoot, midfoot, and heel regions of the outsole, each of the lugs having a largest width of approximately 0.4 inches or less, each of the lugs separated from adjacent lugs by a gap region, and the outsole having a thickness of between about 0.5 millimeters and about 0.8 millimeters in the gap regions; and a compressible foam midsole contained within the upper, the midsole being non-destructively removable from the upper and resting on the lasting element, wherein a bottom of the midsole comprises a plurality of longitudinal sipes and a plurality of transverse sipes formed therein, wherein at least one of the longitudinal sipes includes portions in forefoot, midfoot, and heel regions of the midsole, wherein the transverse sipes include a plurality of transverse sipes in the heel region of the midsole and a plurality of transverse sipes in the midfoot region of the midsole, wherein a top surface of the midsole is configured to receive a plantar face of a foot of a wearer and includes a plurality of raised regions distributed over the top surface, wherein the raised regions are separated by channels, wherein the raised regions have heights relative to surrounding channels of approximately 1 millimeter, wherein the midsole comprises a raised edge that surrounds the top surface and that includes heel raised edge portions, midfoot raised edge portions, and forefoot raised edge portions, and wherein the heel raised edge portions and the midfoot raised edge portions are higher than the forefoot raised edge portions.

2. The article of footwear of claim 1, wherein the lugs and the raised regions are sized such that an average of a cross sectional area of the lugs is within a range of 20% to 500% of an average cross sectional area of the raised regions.

3. The article of footwear of claim 1, wherein the top surface of the midsole is configured to form a footbed and lacks a top cloth.

4. The article of footwear of claim 3, wherein the top surface lacks a liner.

5. The article of footwear of claim 4, wherein the top surface consists essentially of exposed foam material from which the midsole is formed.

6. The article of footwear of claim 1, wherein the midsole comprises an articulated portion comprising the sipes and a spanning portion above the sipes, and wherein the spanning portion has a thickness of approximately 3 millimeters in a footbed region.

7. The article of footwear of claim 6, wherein the lugs and the raised regions are sized such that an average of a cross sectional area of the outsole lugs is within a range of 20% to 500% of an average cross sectional area of the raised regions.

8. The article of footwear of claim 7, wherein the midsole rests directly on an interior surface of the lasting element.

9. The article of footwear of claim 1, wherein a thickness of the midsole in a region configured to receive a receive a forefoot portion of a wearer foot has a thickness between about 3 and about 6 millimeters.

10. The article of footwear of claim 1, wherein the midsole rests directly on an interior surface of the lasting element.

11. The article of footwear of claim 1, wherein the midsole comprises a U-shaped heel reinforcement positioned on a lower outer portion of the heel region of the midsole, wherein the heel reinforcement is formed from a foam that is denser and less compressible than the compressible foam forming other portions of the midsole.

12. The article of footwear of claim 1, wherein the compressible foam of the midsole comprises compressed ethylene vinyl acetate foam.

13. The article of footwear of claim 12, wherein the compressed ethylene vinyl acetate foam has an expansion ratio of at least 189% and not more than 191%, an Asker C hardness value of at least 36 and not more than 40, a specific gravity of at least 0.1 gr/cc and not more than 0.12 gr/cc, a split tear strength of at least 1.2 kg/cm, a compression set of not more than 60%, a tensile strength of at least 14 kg/cm$^3$, an elongation of at least 250%, a tear strength of at least 7 kg/cm, a shrinkage of not more than 2%, and a resiliency of at least 45%.

14. The article of footwear of claim 12, wherein the midsole comprises a U-shaped heel reinforcement positioned on a lower outer portion of the heel region of the midsole, wherein the heel reinforcement is formed from a foam that is denser and less compressible than the compressible foam forming other portions of the midsole.

* * * * *